US011062865B2

(12) United States Patent
Lell

(10) Patent No.: US 11,062,865 B2
(45) Date of Patent: Jul. 13, 2021

(54) ELECTRICAL INTERRUPTION SWITCH, IN PARTICULAR FOR INTERRUPTING HIGH CURRENTS AT HIGH VOLTAGES

(71) Applicant: Peter Lell, Moosburg (DE)

(72) Inventor: Peter Lell, Moosburg (DE)

( * ) Notice: Subject to any disclaimer, the term of this patent is extended or adjusted under 35 U.S.C. 154(b) by 130 days.

(21) Appl. No.: 16/468,861

(22) PCT Filed: Oct. 4, 2017

(86) PCT No.: PCT/DE2017/100844
§ 371 (c)(1),
(2) Date: Jan. 21, 2020

(87) PCT Pub. No.: WO2018/001420
PCT Pub. Date: Jan. 4, 2018

(65) Prior Publication Data

US 2020/0211801 A1 Jul. 2, 2020

(30) Foreign Application Priority Data

Dec. 13, 2016 (DE) ..... 102016124176.8

(51) Int. Cl.
*H01H 39/00* (2006.01)
*H01H 85/02* (2006.01)
(Continued)

(52) U.S. Cl.
CPC ..... *H01H 39/006* (2013.01); *H01H 9/0066* (2013.01); *H01H 9/02* (2013.01); *H01H 85/0241* (2013.01); *H01H 2039/008* (2013.01)

(58) Field of Classification Search
CPC ..... H01H 39/006; H01H 9/0066; H01H 9/02; H01H 85/0241; H01H 2039/008
(Continued)

(56) References Cited

U.S. PATENT DOCUMENTS 2,924,147 A * 2/1960 Bohl ..... F42B 3/006 89/1.14
3,803,374 A * 4/1974 Delgendre ..... H01H 39/004 200/61.08
(Continued)

FOREIGN PATENT DOCUMENTS

DE 2103565 A1 8/1971
DE 19749133 A1 5/1999
(Continued)

OTHER PUBLICATIONS

Lell, "Electrical interruption switch i.e. pyrotechnic interruption switch, for interrupting high currents at high voltages in e.g. motor car, has fire extinguishing agent injected to avoid occurrence of arc between ends of separation region", Entire Document (Translation of DE 102014107853) (Year: 2014).*
(Continued)

*Primary Examiner* — Stephen S Sul
(74) *Attorney, Agent, or Firm* — Perry + Currier, Inc.

(57) ABSTRACT

An electrical interruption switch for interrupting high currents at high voltages includes a casing, surrounding a contact unit defining a current path through the switch, and a pyrotechnic material, comprising a gas and/or shock wave-generating, activatable material. The contact unit has first and second connection contacts and a separation region. The pyrotechnic material and contact unit are formed such that a current to be interrupted is supplied to the contact unit via the first connection contact and discharged therefrom via the second connection contact, or vice versa. When the pyrotechnic material is ignited, the separation region is exposed to a gas pressure and/or shock wave, such that the separation region is torn open, caved in or separated. At least one chamber in the switch, at least partially delimited by the separation region, is filled with a filling material.

20 Claims, 18 Drawing Sheets

(51) Int. Cl.
*H01H 9/00* (2006.01)
*H01H 9/02* (2006.01)

(58) Field of Classification Search
USPC ..... 337/401
See application file for complete search history.

(56) References Cited

U.S. PATENT DOCUMENTS

| | | | | |
|---|---|---|---|---|
| 3,848,099 | A * | 11/1974 | Christian | H01H 33/16 200/61.08 |
| 5,877,563 | A * | 3/1999 | Krappel | H01H 39/006 180/271 |
| 7,511,600 | B2 * | 3/2009 | Von Behr | H01H 39/006 200/61.08 |
| 8,432,246 | B2 * | 4/2013 | Suzuki | H01H 39/006 337/157 |
| 8,957,335 | B2 | 2/2015 | Sprenger et al. | |
| 9,911,560 | B2 | 3/2018 | Lell | |
| 10,661,656 | B2 * | 5/2020 | Hammerschmidt | B60L 3/0007 |
| 10,714,276 | B2 * | 7/2020 | Moszynski | H01H 33/75 |
| 2006/0049027 | A1 * | 3/2006 | Iversen | H01H 39/006 200/61.8 |
| 2013/0175144 | A1 * | 7/2013 | Sprenger | H01H 39/006 200/61.08 |
| 2016/0343524 | A1 * | 11/2016 | Gaudinat | H01H 39/006 |
| 2017/0263403 | A1 * | 9/2017 | Marlin | H01H 71/10 |
| 2017/0314582 | A1 | 11/2017 | Lell | |
| 2019/0051478 | A1 * | 2/2019 | Warenits | H01H 39/006 |
| 2019/0122842 | A1 * | 4/2019 | Masumoto | F42B 3/006 |

FOREIGN PATENT DOCUMENTS

| | | | |
|---|---|---|---|
| DE | 10028166 | A1 | 12/2001 |
| DE | 102010035684 | A1 | 3/2012 |
| DE | 10201201349 | B3 | 9/2013 |
| DE | 102014107853 | A1 | 7/2014 |
| DE | 102014115397 | A1 | 12/2014 |
| DE | 102014108245 | A1 | 12/2015 |

OTHER PUBLICATIONS

"International Search Report" dated Dec. 18, 2017, issued in corresponding PCT application No. PCT/DE2017/100844, filed Oct. 4, 2017, Entitled: "Electrical Interruption Switch, in Particular for Interrupting High Currents at High Voltages".

* cited by examiner

ELECTRICAL INTERRUPTION SWITCH, IN PARTICULAR FOR INTERRUPTING HIGH CURRENTS AT HIGH VOLTAGES

The invention relates to an electrical interruption switch, in particular for interrupting high currents at high voltages.

Such switches are used for example in power plant and motor vehicle technology, and also in general mechanical and electrical engineering in electric switchboards of machines and plants, as well as within the framework of electromobility in electric and hybrid vehicles, but also in electrically operated helicopters and aircraft, for the defined and fast disconnection of high-current electrical circuits in case of an emergency. It is required of such a switch that its tripping and interruption function must still be reliably guaranteed even without maintenance after up to 20 years. Furthermore, such a switch must not give rise to any additional potential danger due to hot gas, particles, ejected fragments or leaking plasma.

One possible area of application in motor vehicle technology is the defined, irreversible disconnection of the on-board wiring from the car battery or drive battery shortly after an accident or generally after a short-circuiting operation caused in another way, for example by a defective power train or a defective electric motor, in order to avoid ignition sources through sparks and plasma which occur for example if cable insulations have been abraded by body sheet metal penetrating during the accident or if loose cable ends press against one another or against sheet-metal parts and abrade. If gasoline leaks at the same time in the case of an accident, such ignition sources can ignite inflammable gasoline-air mixtures which accumulate under the engine hood, for example. Further areas of application are the electrical disconnection of an assembly from the on-board electrical system in the event of a short circuit in the assembly concerned, for example in an independent electric heating system or in an electric brake, as well as the emergency shutoff of a lithium battery, such as are used today in electric and hybrid vehicles, as well as in aircraft. These batteries, with a small overall installed size, have a high terminal voltage of up to 1200 V with extremely low internal resistance. Both of these can potentially result in a short-circuit current of up to 5000 A, in some cases and briefly even up to 30 kA, without the source voltage dropping significantly, which even after a few seconds can lead to the battery igniting or exploding. The interruption switch presented here is also highly suitable for the emergency shutoff of individual solar cell modules or entire solar cell arrays should it be necessary, because it can be designed triggerable or remote-controllable. Furthermore, it can also be designed such that, in addition or instead, it trips passively, thus it can also simultaneously take on the function of a conventional safety fuse.

All use cases mentioned here as a rule involve shutting off direct current, which, unlike alternating current, has no zero crossing. This means that an electric arc, once formed in or on the switch, is not extinguished by itself, but rather remains stable and vaporizes all the materials in its reach here due to its extremely high temperature of several 1000° C., and also produces highly toxic gaseous substances in addition to its extreme thermal action and emitted radiation energy.

It is therefore disproportionately more difficult to disconnect high-voltage direct currents than to disconnect or shut off high-voltage alternating currents and even more difficult the higher the lead inductance and the lower the effective resistance at the moment in the electric circuit.

Pyrotechnic fuses that are triggered actively for tripping are known in the state of the art. For example, DE 2 103 565 describes an interrupter which comprises a metal casing which is connected, at two terminal regions spaced apart from each other, in each case to one end of a conductor that is to be protected. The current path runs via the casing. A pyrotechnic element which is formed by an explosive charge is provided in the casing. The explosive charge can be activated by an electric igniter which comprises an ignition element which is vaporized by a supply current. The casing is filled with an insulating liquid. The axially extended casing has a circumferential groove, along which the casing tears if the explosive charge is ignited. The casing is broken into two parts that are electrically separate from each other, with the result that the electric circuit concerned is disconnected. The plasma forming when an electric circuit with very high amperage is disconnected is extinguished by the atomized insulating liquid in the case of this interrupter. In the case of a motor vehicle, the tripping can be effected by the signal of a shock sensor, for example.

Self-tripping for disconnecting the electric circuit if the conductor to be protected is overloaded is not provided in the case of this known device because the entire sheath would have to be heated up to the tripping temperature and then a detonative reaction would not be reliably achieved. This is because it is difficult to ignite an explosive, i.e. to cause it to react detonatively, simply by heating the sheath. However, e.g. in the casing form described in DE 2 103 565 this would be necessary.

It may be mentioned that in pyrotechnics the term "detonative reaction" is used universally if flame front speeds of, by definition, more than 2000 m/s are reached.

A further disadvantage of this known device is the problem of authorization for devices which have assemblies filled with explosives or even detonators and have outward effects. For this reason, such devices have to date not been used commercially. They are used only very rarely in research institutes for special experiments. This is also due to the very low handling safety and the extremely high potential danger that can only be limited with great difficulty.

Furthermore, in many cases there is a demand for a self-tripping function of such a switch or of a fuse device, for example in order, without additional outlay for overload sensors, to protect a cable against overload or in the event of a failure of the tripping sensor system or trip circuit. A corresponding switch is therefore not only to be capable of being tripped triggerably, but also to have the function of a conventional high-current fuse, in the form of a safety fuse which anyone can handle safely, such as is the case with conventional safety fuses.

Such high-current safety fuses have the disadvantage of a shutoff time that varies within a large range after the rated amperage of the fuse has been reached. A cable protected in this way can therefore only be utilized to a very small proportion, e.g. 30%, of its current-carrying capacity, as otherwise a cable fire, for example, can occur in the event of an overload. The most severe disadvantage of safety fuses, however, is the situation where they form a conductive channel internally around the fuse element when very small excess currents are shut off, with the result that although the fuse element melts, the current is nevertheless not shut off thereafter because the current now flows via the conductive channel here.

From DE 197 49 133 A1 an emergency circuit breaker for electric circuits is known which makes both self-tripping and triggerable tripping possible. For this an electrical conductor which has a pyrotechnic core is used. This can consist e.g. of a pyrotechnic material. The pyrotechnic core can on the one hand be ignited by the heating of the electrical conductor if a permissible amperage (rated amperage) is exceeded. On the other hand, it is provided to ignite the pyrotechnic core using a triggerable ignition device, for example in the form of a glow wire. However, DE 197 49 133 A1 merely describes the principle of such a device, but gives no indications whatsoever of possible designs that can advantageously be constructed. This is because producing a conductor with such a pyrotechnic core requires a considerable outlay. In addition, even in the case of such an emergency circuit breaker, a reliable, fast disconnection of the conductor can be guaranteed only if a detonative explosive substance is used. In deflagrating substances, i.e. substances that do not react detonatively, such as thermite or nitrocellulose powder, the conductor merely bursts open and the remaining gas escapes without the conductor being completely disconnected. Complete disconnection is then if need be achieved by the melting-through of the conductor as a result of the current flowing via the fuse. However, at higher voltages, in particular even at switching voltages of more than 100 V, this would necessarily lead to ion generation and thus plasma formation in the fuse and would thus in all probability prevent the interruption of the electric circuit.

From DE 100 28 168 A1 by the applicant an electric connecting element, in particular for connecting high currents, is known which can be formed to be activatable both actively, i.e. by means of a triggerable ignition device, and passively, i.e. via the amperage of the current to be shut off. The connecting element has a casing which comprises a contact unit, wherein the contact unit has two connection contacts connected in a fixed manner to the casing or formed in one piece therewith for supplying and discharging an electrical current to be connected, and wherein the two connection contacts, in the initial state of the connecting element, are electrically conductively connected inside the casing. In the casing, an activatable material is provided which after the activation generates a gas pressure which is exerted on the contact unit, wherein the electrically conductive connection is disconnected by the exertion of the gas pressure. The contact unit comprises a contact element which is movable relative to the fixed connection contacts by means of the exertion of the gas pressure generated and which, due to the exertion of the gas pressure generated, is moved in the direction of the axis of the contact unit from its starting position into an end position, in which the electrical connection is interrupted via the contact unit.

This connecting element is designed such that there is no movement whatsoever of parts towards the outside. In addition, in the case of an activation, no dangerous gases or fragments whatsoever escape to the outside.

However, it has transpired that such switching units have only limited suitability for shutting off very high direct currents at higher voltages, since due to the interruption of the separation region as a result of the disconnection of the electric circuit here an electric arc is always drawn, which cannot be prevented because of the energy that is stored in the lead inductance at the moment of disconnection in the magnetic field thereof and released at the moment of disconnection of the electric circuit. Attempts to use an extinguishing agent which, in the initial state before activation, surrounds the separation region have shown that the desired success, namely to prevent the formation of an electric arc or to reliably extinguish an already existing electric arc, is not achieved by this means alone.

In the case of known pyrotechnic drives, whether integrated into any device or as an independent device, the activatable material which is provided to generate the pressure or pressure surge (also referred to as shock wave in the following) is introduced into a combustion chamber. The volume of the combustion chamber is usually also the volume of the powder chamber and usually includes the volume which the pyrotechnic material requires to be stored in the assembly before it is triggered. However, if, depending on the volatility or burning rate of the pyrotechnic material, only a small quantity of the activatable material is required, or if as little activatable material as possible is to be contained in the assembly for reasons of the highest possible level of safety in the event of an accident, there is often the problem that the combustion chamber cannot be formed small enough, or that the activatable material, which is often present in solid form, for example compressed form, cannot be produced with the tolerance required in order to fill up the entire combustion chamber. The residual volume of the combustion chamber, which is not taken up by the activatable material, and the air present therein or the gas present therein limits in particular the steepness of the pressure increase, which is generated after the activation of the activatable material, additionally requires energy that dwindles away in the actual process of breaking open the so-called separation region and then the acceleration operation of the membrane or of the piston and also attenuates any type of shock wave that could have been used to break open the separation region in the case of minimal use of pyrotechnic material. The residual volume filled with air or a gas thus reduces the transmission of a rapid mechanical impulse to the drive element of the pyrotechnic drive device (also referred to as sabot in the following).

With regard to safety aspects, both the smallest possible mass of pyrotechnic material and at the same time the smallest possible void volume in the assembly are also desirable: any void volume can be depressed by the pyrotechnic reaction by the gaseous reaction products being formed here, thus an energy reservoir can be created after the ignition, which is discharged when, for example, the assembly has been overloaded just once and ruptures. The "high-pressure gas reservoir" thus created would then be discharged with a corresponding bang and parts being flung around—which cannot happen if there are no void volumes in the assembly or gas-filled volumes after the tripping of the assembly.

It may be pointed out at this point that in the context of this description any material that reacts in a deflagrating or detonative manner (for example that burns away) is referred to as activatable material. This also includes mixtures of materials that react in a deflagrating manner, such as for example thermite mixtures or tetrazene. A material that reacts in a deflagrating manner generates amongst other things gaseous reaction products and a pressure increase or a pressure wave, the propagation velocity of which is less than or equal to the sound velocity of the medium concerned. A material that reacts detonatively on the other hand additionally generates a pressure change, referred to as pressure surge or shock wave, in the medium concerned, the propagation velocity of which is greater than the sound velocity in the loaded medium.

This essentially results in two different types of pyrotechnic drive devices:

If an activatable material that reacts in a deflagrating manner, i.e. relatively slowly, is used, a relatively slow pressure increase or a relatively slow pressure change or pressure wave in the millisecond range in the surrounding medium results. If this relatively "slow" pressure increase acts for example on a sabot or a tubular segment, the latter undergoes a deformation or is moved. Both effects on the sabot or a tubular segment are also possible. Such a relatively slow pressure increase is usually utilized to cause an increase of the combustion chamber volume.

If an activatable material that reacts detonatively is used, the pressure surge generated or the shock wave originating from it is above all to be utilized in order firstly to quickly and violently tear open an assembly segment for example, here a tubular segment, or the separation region, i.e. here the electrical conductor, and then to generate the output power of the pyrotechnic material.

Here the property of detonative materials to be able to produce a significantly higher energy density, the action of which can be implemented more effectively in the desired place with at the same time a significantly lower material use, in comparison with deflagrating materials is utilized. However, it is particularly important here to couple the detonative material or the shock wave generated by it to the desired place of action.

Furthermore, it is desirable to keep the quantity of the pyrotechnic material as small as possible in such interruption switches, so that not only pyrotechnic materials that react detonatively, but also pyrotechnic materials that react in a deflagrating manner can be used, and an adequate disconnection of the current path is nevertheless effected. Furthermore, it is also desirable for reasons of safety and cost to minimize the quantity of the pyrotechnic material.

Starting from this state of the art, the object of the invention is to create a pyrotechnic interruption switch, in particular for interrupting high currents at high voltages, in which the shutting off of high currents at high voltages is also reliably guaranteed by the avoidance or at least the effective attenuation of a current maintained by an electric arc. The quantity of pyrotechnic material to be used is to be as small as possible and nevertheless to guarantee the shutting off. In addition, a switch is to be created which is largely non-hazardous in terms of safety and can be produced in a simple and cost-effective manner.

The invention achieves this object with the features provided herein.

In the electrical interruption switch according to the invention, a pyrotechnic material can be used for performing the switching operation in such a small quantity that, although the shock wave generated does not damage the casing of the interruption switch, it can nevertheless interrupt high currents at high voltages. Here, not only deflagrating pyrotechnic materials, but advantageously also detonative pyrotechnic materials generating shock waves can be used.

The electrical interruption switch according to the invention thus has a casing, which surrounds a contact unit defining the current path through the interruption switch. A pyrotechnic material is provided, which is a gas-generating and/or shock wave-generating, activatable material. The contact unit has a first and second connection contact and a separation region. The pyrotechnic material and the contact unit are formed such that a current to be interrupted can be supplied to the contact unit via the first connection contact and can be discharged therefrom via the second connection contact (or vice versa), and that, when the pyrotechnic material is ignited, the separation region is exposed to a gas pressure and/or shock wave generated by the activatable material, with the result that the separation region is torn open or caved in and thereby separated. The insulation spacing is chosen such that it is easily sufficient, for the respective voltage to be connected, to maintain the source voltage reliably, i.e. discharge-free, after the separation. At least one chamber in the interruption switch is at least partially delimited by the separation region and is substantially completely filled with a filling material, preferably with silicone oil. In this way the separation region is in contact with the filling material.

By "substantially completely filled" is meant that, apart from unavoidable gas bubbles which are present for example due to the surface tension of the filling material or caused by difficulties during the filling, the entire space of the respective chamber is filled up with the filling material.

According to a design of the invention, the separation region can be designed such that it at least partially surrounds a chamber, preferably a combustion chamber, i.e. the wall of the separation region at least partially delimits the one chamber.

According to a design of the invention, the separation region can separate the one chamber from a further chamber. This further chamber surrounds the separation region, preferably in an annular manner. If not only the one chamber, but also the space of the further chamber is filled with filling material, the separation operation of the separation region takes place entirely in the filling material, with the result that an electric arc forming during the initial breaking open is extinguished immediately to quickly, and further discharge phenomena can easily be prevented. According to a design of the invention, during the separation of the separation region the one chamber can thus be connected to the further chamber. According to a design of the invention, both the one chamber and the further chamber can thus be substantially completely filled with the filling material.

According to a design of the invention, the pyrotechnic material can be located in the chamber which is filled with the filling material. In this way the shock wave can act directly via the filling material with its specific, as a rule very low resistance to shock waves.

The pyrotechnic material is preferably provided with a protective layer, preferably made of natural rubber and/or epoxy resin, which prevents the filling material from deactivating the pyrotechnic material before it is activated. The pyrotechnic material is present in the interruption switch according to the invention, preferably in the form of a so-called mini detonator, or an ignition tablet or squib, but can also be introduced in another form.

According to a design of the invention, the pyrotechnic material is located in the one chamber, i.e. the one chamber is then the combustion chamber. However, embodiments are also conceivable in which the pyrotechnic material is provided in the further chamber, for example in an outer region of the further chamber inside the casing (see FIG. 11) or even outside the casing, wherein here the energy generated or the pressure or the shock wave acts on the separation region and the sabot via a pressure line (see FIG. 12).

The filling material preferably contains a material with good electrical insulation properties. It preferably contains a material which decomposes into an insulator again under the action of energy or during its own decomposition. Both properties can however also be achieved by one material alone, as is the case with silicone oils: the oil with good electrical insulation properties is decomposed e.g. by the effect of an electric arc and in this case to give silicon dioxide, which is also a good electrical insulator.

The pyrotechnic material is usually housed in the one chamber, but embodiments are also conceivable which contain the pyrotechnic material in the outer region of the further chamber inside the casing (see FIG. 11) or even outside the casing via a pressure line (see FIG. 12) and supply the pressure or the shock wave in this way to the separation region. Here too, all void volumes can successfully be or become filled with fluid, as can be seen in the two figures. In both last-named cases the separator material in the separation region would either be pushed inwards or simply only be torn longitudinally after the separation.

The presence of a filling material in at least one of the chambers also has the advantage that the surface, for example, of the mini detonator is electrically well insulated from the inner or outer wall of the separation region. The presence of a filling material in the one chamber or the further chamber also has the advantage that the proportion of gas therein can be greatly reduced, so that with only a small quantity of gas generated by the mini detonator a high pressure can be exerted on the separation region and an optional sabot. Thus so much pressure can be generated very effectively, i.e. with little gas or reacted pyrotechnic material, that even a separation region of the contact unit realized with thick material tears open well and then an optionally present sabot is also depressed and thus an optionally present upsetting region is compressed or folded up. Through the gas volume in the chamber and/or the further chamber that is reduced by the filling material, it can also be achieved that little pressure energy is stored and thus no great undesired effect outwards occurs during bursting of the casing of the interruption switch after an overloading of the assembly. Only in a gas volume could energy appreciably be stored, which could then manifest itself explosively during opening of the casing of the interruption switch. Furthermore, the resistance to shock waves in the one chamber or the further chamber is greatly reduced, or the separation region is quasi-acoustically coupled to the mini detonator, by the filling material. Here, pressures of far more than 1 kbar are achieved in the shock wave front. The migration of this pressure disturbance or the pressure energy in the direction of the wall of the separation region would be impeded, abated or attenuated by a gas volume. Through the introduction of a filling material with a lower resistance to shock waves as a gas, the energy generated, for example, by the mini detonator can be used, as unweakened as possible, for the destruction of the separation region and for acting on an optionally present sabot, and not for heating and depressing the gas. The use of, for example, silicone oils results in an improvement or intensification of the shock wave of between 1000× and 4000× compared with air.

If the pyrotechnic material is ignited, the presence of the filling material facilitates the propagation of the shock wave with a significantly lower attenuation, with the result that the separation region can be torn open and the sabot depressed significantly more effectively, than in the presence of a gaseous material. The interruption switch according to the invention can thereby switch significantly more efficiently and quickly, compared with a switch which contains a gaseous filling material. It has also transpired that by using a filling material according to the invention the thickness of the separation region can also be greatly increased, without a larger quantity of pyrotechnic material, which is otherwise usual, having to be used for the successful separation. In this way the interruption switch according to the invention can be used for far higher currents at higher voltages, without resulting in an unacceptable heating of the separation region.

According to a design of the invention, the contact unit can have an upsetting region. The upsetting region can be designed in such a way that it surrounds a yet further chamber. The upsetting region can be designed such that it is upset during the separation operation of the separation region. It is preferred for the material of the upsetting region to be an easily deformable, optionally also soft-annealed material, in order to improve the folding behavior of the upsetting region.

In tests with such an assembly it has also been shown that, after the separation of the separation region and the formation of the electric arc, a small quantity of the filling material vaporizes, thus extracts energy from the electric arc, but at the same time produces an additional quantity of gas, which acts on the separation region and the sabot and effectively depresses them. The separation and the upsetting of the upsetting region thereby becomes ever quicker and more effective the higher the current to be shut off and thus the initially generated electric arc are. This is a very welcome effect, which means that the interruption switch according to the invention can still be used in the case of extremely high currents to be disconnected.

According to a design of the invention, the yet further chamber of the upsetting region can also be completely filled with the filling material. Through the movement of the sabot and/or the upsetting operation of the upsetting region, the volume of the yet further chamber is reduced such that the vaporizable medium is injected through the at least one channel between the at least two parts of the separation region. In this case it is preferred for the yet further chamber to be connected to the one chamber via a bore (channel). The filling material can thereby be pushed out of the yet further chamber via the channel into the one chamber during the upsetting operation and thus more effectively suppresses or cools the electric arc possibly still present at the separation region. At the same time the extinguishing agent, which may have already partially decomposed in the one chamber, is diluted by the medium newly flowing in, and thus the insulating properties of the "stressed" extinguishing agent are likewise improved. In this design of the invention it may also be preferred for only the one chamber and the yet further chamber as well as the connecting channel to be filled with a filling material. It may be preferred here for the further chamber to contain no filling material.

According to an embodiment of the invention, the upsetting region can be designed with regard to the material and the geometry such that the wall of the upsetting region is folded, preferably folded in a meandering fashion, as a result of the upsetting movement.

In an embodiment of the invention, the upsetting region can have at least one perforation, which makes a connection between the yet further chamber and a volume surrounding the yet further chamber possible. In this way additional filling material can be made available during the upsetting operation, and the volume, increasing due to the movement of the sabot, of the one and of the further chamber can be refilled with filling material. More extinguishing agent is thereby available for the switching electric arc and additional possible work is available for the magnetic energy stored in the circuit inductance at the moment of separation of the separation region, with the result that the material of the upsetting region can be better reshaped. Because more extinguishing agent is available the electric arc forming in the separation region can be better cooled or disrupted. Furthermore, a gas space can also be prevented from forming in the chamber volume around the separation region. The quantity of gas in the depressed space can also be kept as small as possible after the tripping, and thus the explosion risk associated with a highly depressed gas space can be minimized. Furthermore, in this way the filling material partially converted by the electric arc can be diluted by the newly injected filling material. Better insulation values are achieved thereby. Through the filling of the yet further chamber, the extinguishing time is also lengthened by delaying the upsetting operation. It is thereby achieved that the current shutoff also still functions in the case of larger time constants of circuit inductance and circuit resistance: the upsetting time determines the time in which the filling material is injected into the one chamber and further chamber and thus particularly effectively cools, disrupts and through material conversion or vaporization allows the electric arc present there to work. If the time constant of load resistance and the circuit inductance is greater than the time which is available during or through the upsetting, the interruption switch can no longer cool the current then still flowing after the end of the separation operation, and thus the electric arc still present then. The internal pressure due to vaporized filling material thereby increases, and the undesired destruction or explosion of the interruption switch can result. The magnetic energy stored in the circuit inductance at the time of the shutting off or the tripping of the interruption switch must be converted into other forms of energy. According to the invention the following possibilities are available for this conversion:

heating and ultimately the vaporization of the filling material or the at least partial chemical conversion thereof when it is in contact with the electric arc, upsetting of the material of the contact element in the upsetting region, heating of the filling material by flow resistances during the upsetting of the upsetting region (through appropriate design of the overflow surfaces the upsetting time here can be adapted to the maximum time constant, or the time constant actually present, of circuit inductance and load resistance according to the equation tau=L*R).

The introduction of a perforation in the upsetting region has the advantage that by way of its size the flow resistance of the liquid overflowing here during the compression of the upsetting region is high enough or can be set to be optimal for the switching operation. The filling material can thereby better absorb the magnetic energy stored in the circuit inductance at the time of the separation or convert it into other forms of energy.

In a design of the invention, thermites can be introduced into the filling material. Here all designs are conceivable: mixing thermites into the filling material of the one chamber, of the further chamber and/or of the yet further chamber. In a design, the further chamber can also contain thermites in powder form.

The at least one channel can be formed nozzle-like. In particular, the channel can be aligned such that it is aimed in its extension direction at the fixed separated end of the separation region.

According to an embodiment of the invention, the separation region can be formed hollow-cylindrical and preferably annular in cross section. In this case, the one chamber is located in the interior of the hollow cylinder and is thus partially delimited by it. The further chamber surrounds the upsetting region, preferably in an annular manner.

The upsetting region can also be formed hollow-cylindrical and preferably annular in cross section. The filling material can thus be introduced inside the hollow cylinder. An annular cross section promotes a uniform folding, viewed over the circumference, of the hollow cylinder wall during the upsetting operation.

The length of the hollow cylinder in the separation region/the length of the switch separator preferably lies in the range of from 3 mm to 15 mm, more preferably in the range of from 5 mm to 10 mm and even more preferably in the range of from 6 mm to 8 mm. For special cases, however, separator widths of 1 mm are also advantageous, in particular if switching is to be effected particularly quickly. The wall thickness of the hollow-cylindrical separation region/the material thickness of the switch separator can be up to 1000 μm; the range from 400 μm to 700 μm is preferred here. In the case of previous interruption switches without filling material in the combustion chamber or the further chamber, the wall thickness had to be reduced down to 150 μm here because only then could a separation in the separation region be ensured without having to increase the quantity of pyrotechnic material to an undesired extent. In spite of the now very large material thickness of the switch separator, the quantity of pyrotechnic material can be kept very small. Thus according to the invention only approximately 30 mg to 100 mg of an activatable material is necessary. In the case of earlier interruption switches without filling material in the combustion chamber or the further chamber, up to five times the quantity of activatable material had to be used in order that the separation region was reliably severed. According to a design of the invention, the separation region can be formed of a metal which can form an alloy with a soft solder material. The effect that an alloy has a much lower melting point compared with the metal in the non-alloy state is exploited here. In this way, from a certain threshold amperage a temperature can be achieved at which, in combination with the duration of exposure to this temperature, the alloy formation commences, with the effect that the melting temperature of the separation region at this point is dramatically lowered. By lowering the melting temperature the separation of the separation region and the formation of the electric arc between the two ends of the separation region occur much earlier; the assembly can thus already switch passively at lower currents or also simply only disconnect the electric circuit earlier/more quickly after the action of an excess current. The soft solder material is preferably arranged on the surface of the metal of the separation region. Here, in the case of a hollow-cylindrical or hollow-prismatic design of the separation region, the soft solder material can be applied circumferentially. Furthermore—independently of the design of the separation region—the soft solder material can also be applied to one or more delimited surface(s). The soft solder material can however also coat the entire separation region. The soft solder material can be applied thermally, by pressing it on or by other suitable methods. The base material of the separation region can consist, for example, of copper. In this case, for example, tin can be used as soft solder material. However, all combinations of materials from which an alloy can be formed are also conceivable for the base material and the soft solder material. Two or more different soft solder materials can also be used in combination. Upon reaching the threshold amperage the solder atoms can penetrate into the base material and produce an intercrystalline region there, in which the melting temperature is lowered. For example, during the heating up of the contact unit by the current flowing through it the melting temperature of a copper used for the contact unit can hereby be lowered from 1075° C. to only 175° C. This effect is known; it is thus already introduced in some safety fuses—and can also be used successfully in the case of the protective element described here.

In a design of the invention, the separation region is preferably designed such that it has predetermined breaking points, for example in the form of narrowings, notches, holes or cross-sectional jumps. In this way the separation region can be designed such that it is more easily separated into at least two parts, and consequently the interruption switch disconnects and shuts off the electric circuit more quickly and cleanly, i.e. with the release of the fewest possible and, if this is unavoidable, at least the smallest possible particles. According to this design of the invention, during the separation of the separation region the one chamber can thus be connected to the further chamber. Here, it is preferred for both the one chamber and the further chamber to be filled with the filling material. However, the further chamber can also contain a medium which is in powder form or in the form of an oil-wet powder. Here, the powder can be made of all conceivable types of rock (preferably as rock flour), cements, chamottes, aluminas, ground or sintered silicates or corundums. If it is an oil-wet powder, silicone oil is preferably used here.

According to a design of the invention, the hollow-cylindrical separation region can have one or more grooves, which are preferably circumferential grooves. The separation region can have a circumferential groove, for example, on the outside and in the center relative to its width, in order to ensure that, during or shortly after the tripping of the interruption switch, it also breaks open early even in the case of a very thick wall thickness here through the use of relatively little pyrotechnic material and the two separated ends effectively roll up/bead well. It is thus ensured that no larger material shreds are formed. At the same time both contact ends formed are reinforced by the beading and the electric arc also forming here is thus prevented from vaporizing too much material of the relatively thin separator of the separation region and thus being further fueled.

The hollow-cylindrical separation region can, however, also have two circumferential grooves, preferably one in proximity to the geometrical origin of the separation region (e.g. at the end of the radius of the cross-sectional jump) and one in proximity to the end of the separation region (e.g. at the end of the radius of the cross-sectional jump). It is thereby achieved that, during or after the triggering of the pyrotechnic material after its activation, a sufficiently large portion of the separator of the separation region breaks off, is ejected inside the fuse and is thus no longer vaporized by the electric arc that is forming or has formed. Significantly less conductive material is thereby produced inside the interruption switch due to the electric arc, so that the insulation behavior is dramatically improved according to function or separation operation and the electric arc is additionally weakened, thus combustion material is effectively removed therefrom.

The hollow-cylindrical separation region can furthermore also have further circumferential grooves. If the width of the grooves is chosen to be sufficiently narrow relative to the length of the hollow-cylindrical separation region in the extension direction of the hollow cylinder, the loop-in resistance is not increased by these grooves, but rather they only have a mechanical effect, as desired.

According to a design of the invention, the hollow-cylindrical separation region can also have a circumferential thickening, e.g. in the form of a small lump. Such a small lump acts as a heat sink and as a reinforcement. The hollow-cylindrical separation region preferably has two circumferential grooves on both sides of the small lump. In such an arrangement it is ensured that the separation region is separated at the grooves, and two smaller electric arcs form, which can be cooled or extinguished more easily.

If the pyrotechnic material is housed in the one chamber, a wall of the combustion chamber lying opposite the pyrotechnic material, preferably mini detonator, can be shaped such that it results in a shock wave guidance, as can be seen at the top and bottom in FIG. 10.

Explosive substances, in particular detonative substances, e.g. in particular silver azide, which can be caused to react by heating or electrical discharging, are preferably suitable as activatable (pyrotechnic) material in the combustion chamber. Silver azide is particularly preferably used; it reacts detonatively and is free from heavy metals. However, combustible gases, in particular liquefied gases or other combustible materials, can also be used together with liquid, solid or gaseous oxidizers, which can be caused to react by igniters, electrical discharges, hot wires or exploding wires.

In general, the term "pyrotechnic material" within the meaning of the present description is understood such that it includes all substances or mixtures of substances which after activation in any desired manner generate gases or vapors or shock waves, which break open the separation region, and can exert the desired pressure or the desired shock wave on an optionally present sabot.

The filling material which, as a gas, has a lower resistance to shock waves is preferably a liquid, gelatinous, paste-like, soft rubber-like or granular material. The filling material is preferably a liquid material, for example an oil, in particular silicone oil, or silanes, in particular hexasilane. The choice of silicone oil has the advantage over many other oils that it is converted into solid silicon dioxide on contact with the hot electric arc that decomposes the molecules of the oil. In this way the formation of usually electrically conductive smoke residue or broken molecule chains of carbon-containing liquid or solid substances can be avoided. The silicone oil is preferably a low-viscosity silicone oil with a dynamic viscosity of less than 150 cp, preferably less than or equal to 100 cp.

In particular in order to improve the insulation strength or insulation properties between the two connection contacts after the separation, in a design of the invention a substance for capturing or oxidizing elemental carbon which possibly still arises through the direct contact of the electric arc with the filling material or also the surrounding materials—also a portion of the material of the sabot, of the internal insulation, of the casing and also of the contact unit itself may vaporize—can be added to or mixed with the filling material. This has the advantage that the materials that have decomposed into electrically conductive substances or elements through the contact with the electric arc, such as for example the elemental carbon from the decomposition of a silicone oil itself that is used as filling material (=electrically conductive), are captured or oxidized to form electrically non-conductive or only extremely weakly conductive substances, in order to prevent the electrical conductivity of the filling material from being increased. For example, highly dispersed silica (HDS) can be added to capture elemental carbon. Perchlorates or better permanganates, such as $KMnO_4$, $KClO_4$, $KClO_3$ or zirconium potassium perchlorate (ZPP), can for example be used as substances for oxidizing elemental carbon. At the same time, all named substances have the property of reacting exothermically during the oxidation. In this way the distance between the two separated parts of the separation region can be increased more quickly, which leads to faster extinguishment of the electric arc. In other words, in a design of the invention a substance which during the formation of the electric arc reacts exothermically or releases additional energy for the additional heating and vaporization of the filling material can be added to the filling material.

In a design of the invention, a substance which increases the capacity of the filling material to absorb mechanical energy can be added to the filling material. In this way the energy which can penetrate into the liquid can be converted effectively in a dissipative manner.

In a further design of the invention, it is also possible to add to the filling material one or more substances which increase the insulation strength between the two separated parts of the separation region in that they can absorb very large amounts of energy dissipatively when they are heated, melted and vaporized without simultaneously releasing electrically conductive substances—as in the case of silicone oil. Here, for example, all conceivable types of rock, cements, aluminas, chamotte, ground or sintered silicates or corundums, preferably dispersed in powder form (rock flour) in the extinguishing medium, can be inserted or mixed in.

In a design of the invention, in one of the chambers of the interruption switch, for example in the yet further chamber, a material which locally abates the influence of the shock waves forming when the interruption switch is tripped, in order thus to prevent defined and local premature damage of the materials used, can be added. Such a material can be, for example, a rubber, preferably in the form of a rubber ball. This rubber is preferably attached inside the contact unit on the side of the upsetting region, in order to prevent the upsetting region from tearing open shortly after initiation of the pyrotechnic material. For this, a rubber ball can for example be inserted inside or fitted into a hollow screw closing the interruption switch on the named side.

The at least one channel can be closed by a membrane that can be destroyed during the tripping operation of the interruption switch. This is necessary at least when the filling material is to be present only in the one chamber, but not in the yet further chamber, or vice versa.

However, the at least one channel can also be dispensed with if the tube of the upsetting region is not to be or need not be filled with filling material. Here, the contact unit then has neither a channel nor a membrane.

According to an embodiment of the invention, the interruption switch can have a sabot which, when the pyrotechnic material is ignited, is exposed to a gas pressure and/or shock wave generated by the activatable material in such a way that the sabot in the casing is moved in a movement direction from a starting position into an end position and in the process the upsetting region is plastically deformed, wherein the separation region is completely separated, and in the end position of the sabot an insulation spacing is achieved between the separated ends of the separation region.

The contact unit can have a straight longitudinal axis, along which the sabot is displaceable. The separation region can then be provided bordering the sabot and lying in the longitudinal axis. The at least one channel—if present—can also lie in the longitudinal axis. The contact unit is preferably constructed such that it has a flange between the upsetting region and the separation region, in which the sabot can engage and by the movement of which the upsetting region can be upset.

If a channel is present, and it or the yet further chamber is filled with filling material, the extinguishment of an electric arc or the hindering of the formation of an electric arc is also supported in that, after the separation operation of the separation region and the beginning movement of the sabot, a violent liquid flow forms, which flows over the separation region that has broken open.

The contact unit can consist of an electrically conductive material, preferably copper or aluminum or brass, wherein copper or aluminum is preferred.

However, switches are also conceivable in which the sabot of the contact unit can move in a more or less curved casing, with the result that switches can be manufactured in which the two current connections are at an angle of between 1° and 300°, preferably at 30°, 45°, 90°, 120° or 180°. Thus, in the case of a casing curved by 180°, after tripping and the breaking open of the separation region, the sabot would move in a semi-circle in the casing, with the result that both current connections come to lie on the same side.

The separation region and the pyrotechnic material can be formed such that the separation region, when the pyrotechnic material is ignited, is torn open or at least partially torn open and is separated altogether and further by a displacement movement of the sabot. For example, the pyrotechnic material can be at least partially arranged inside the separation region. When the pyrotechnic material is ignited, the separation region is torn open entirely or at least partially over the circumference. If it is torn open partially, the complete separation is effected by the displacement movement of the sabot and of the portion of the separation region still connected to it after the separation, whereby the upsetting region is simultaneously upset.

However, the separation region can also be designed such that, when the pyrotechnic material is ignited, two non-destructively separable portions of the separation region are pulled apart by a displacement movement of the sabot.

In a design of the invention, concentric copper bands or, in the sabot, copper segments or copper discs, can be inserted on the internal insulation, i.e. the inner insulated side of the casing. In this way the electric arc can easily and quickly release energy thereto via heat conduction and can temporarily store heat/energy here. The electric arc forming is thereby extremely intensively cooled on contact or energy is quickly withdrawn from the electric arc or the circuit inductance. This effect can be increased if the electric arc is forced through an external magnetic field in the direction of these copper bands or copper segments. The strong permanent magnets available today, like coils which the current to be connected itself flows through in series, are suitable for generating the strong magnetic fields that are necessary here—but here again with the disadvantage that they increase the lead inductance, which is actually undesired.

In a design of the invention, it is preferred for the one chamber, the further chamber and the yet further chamber to be filled with a filling material, wherein the filling material can be the same or different in the different chambers. It is preferred for the filling material in the further chamber to be different from the filling material in the one chamber and the yet further chamber. By "different" is also meant filling materials the base material of which is the same, but which can contain one or more identical or different substances in different concentrations. A medium with a higher viscosity than in the other two chambers is preferably used in the further chamber. If silicone oil is used as base material, a substance for capturing or oxidizing elemental carbon is mixed with it, thus it is preferred for the silicone oil in the further chamber to have a higher concentration of said substance than the silicone oil in the one and the yet further chamber. It is preferred here for the concentration to be at least 5 times higher, more preferably at least 10 times higher. Highly dispersed silica (HDS) is preferably used as such a substance. In a strongly preferred embodiment, the concentration of HDS in the further chamber lies in a range from 30 g/l to 70 g/l silica, more strongly 45 g/l to 55 g/l silica.

In a design of the invention, the interruption switch can also have a magnet. Such a magnet is to be designed such that the electric arc is diverted. By diverting the electric arc, the undesired current flow between the two separated ends of the separation region can at least be reduced. Such a magnet can be arranged outside or inside the casing of the interruption switch. For this either permanent magnets or coils can be used. If a magnet is arranged outside the casing, a permanent magnet is preferred. If the magnet is a coil, it is preferably arranged in series with the current flow through the interruption switch. The latter would have the advantage that with increasing excess current the magnetic field would also become greater and would divert the electric arc more strongly. However, such a magnet also has the advantage that the effect of a U-shaped conductor loop could be compensated for in the case of the connection of the interruption switch. If the interruption switch is part of such a U-shaped conductor loop, the electric arc forming in the interruption switch would then be pushed away from the current loop by its own field. In order not to destroy the internal insulation of the interruption switch, such a magnet can be used against this pushing away. However, such a coil or coil arrangement would also increase the circuit inductance, which is in principle undesired.

In a further design of the invention, the interruption switch according to the invention can be connected in an arrangement in parallel with a safety fuse. In other words, the present invention also relates to a device in which an interruption switch according to the invention is connected in an arrangement in parallel with one or more safety fuses. In such a circuit the interruption switch only has the task of shutting off the partial current by itself in the case of the only very low switching voltages here (here only the voltage which, through the current flow via the fuse(s) connected in parallel therewith, falls due to the internal resistance thereof is applied to the interruption switch), thus a corresponding excess current then flows through the safety fuse and shuts it off. The interruption switch then has to hold only the applied source voltage after the connection of the safety fuse(s), which is however not a problem, because here the connection does not have to be carried out while current is flowing. With such an arrangement, the switching capacity of the arrangement can be dramatically increased, in particular also towards medium voltage uses up to 10 kV and currents up to 50 kADC and above, and can then in particular also be used for lead protection with very high circuit inductances.

In a further design of the invention, the interruption switch according to the invention can be connected in an arrangement in series with one or two safety fuses. In other words, the present invention also relates to a device in which an interruption switch according to the invention is connected in an arrangement in series with one or two safety fuses. In these embodiments two safety fuses are preferably used. The two safety fuses here are preferably connected before and after the interruption switch, i.e. connected to the negative and positive terminal of the interruption switch, in order to be able to protect both terminals, because a short circuit can occur both in the negative and in the positive circuit loop. In such an arrangement, the safety fuses have the task of forming a series resistor for the interruption switch in the case of a strong overload and thus above all of limiting the voltage applied to the separation region by the voltage that is falling down to the electric arc voltage in the fuses. In this way the shutting off of the interruption switch can be guaranteed more reliably.

In a further design of the invention, the interruption switch according to the invention can be connected in an arrangement in series with one or two relays. In other words, the present invention also relates to a device in which an interruption switch according to the invention is connected in an arrangement in series with one or two relays. In these embodiments two relays are preferably used. In this way the switching capacity of the interruption switch can be increased. The relays have, in addition to their function as usual operating switches, the task of limiting the excess current in the overload range to such an extent that the current can be reliably shut off by the interruption switch. The relays preferably have contacts that lift off electrodynamically in the case of overload (levitating contacts). Through the lifting off of the contacts in the case of overload, the increase in the voltage measured at the moment of separation of the separation region is lowered to just above the operating voltage and thus, in a similar way to the described safety fuses in series with the interruption switch, the applied or effective voltage on the assembly at the moment of the separation operation is reduced. Without such contacts the voltage would increase to three times the operating voltage through the discharging of the inductance on the load side. A powerful electric arc would thereby be ignited, which would be much more difficult to extinguish.

In a further design, wire clamps or wire angle brackets are electrically and mechanically connected to one or both contacts of the interruption switch such that the interruption switch can thus easily be screwed onto or placed on a flat plate, and contact mountings, which were to be used previously, no longer have to be used. This is particularly important in aviation and in the automotive sector, because substantial weight savings can thus be achieved.

In a further design of the interruption switch, the latter is formed as part of a slide with or without a hand grip, which can thus be easily introduced into an existing electric circuit or removed again. Simple safety measures can also be integrated here, for example for shutting off the electric circuit when the slide is pulled through a closed circuit, which for example allows a contactor to drop out during pulling before the final disconnection of the switch from the electric circuit when it is removed, in order thus to reliably enforce the currentless state thereof when the assembly is removed.

The internal insulation can thus be formed as a hard-anodized layer in a casing made of aluminum or as a ceramic or AVC coating of a steel casing. Most O-rings can be injection-molded into or onto the plastic parts, then no longer have to be fitted individually here and can then also no longer be forgotten. All non-movable electrically insulating parts, i.e. all except the casing and the sabot, can also be insert-molded around the contact unit. Thus, the number of individual parts and of assembly steps, as well as consequently the production costs of the assembly, can be dramatically reduced.

In a design of the invention, the interruption switch can have one or more heat sinks. In the further chamber, heat sinks can be deposited for example on the sabot, and/or on the internal insulation of the casing. Cu, Ag, brass or steel come into consideration as a material for heat sinks. Here it is preferred for the heat sinks to be coated with Ni in order to prevent corrosion and thus poorer heat transfer. Heat sinks can absorb energy and, in the process, cool the interruption switch or the electric arc.

In a design of the invention, the contact element can have a first connection contact region containing the first connection contact and a second connection contact region containing the second connection contact, wherein the first connection contact region can be arranged lying in the longitudinal axis bordering the upsetting region, and the second connection contact region can be arranged lying in the longitudinal axis bordering the separation region.

In a design of the invention, the first connection contact region can be designed hollow-cylindrical and preferably annular in cross section. In this way, in the case of the electrical interruption switch of the invention, a third connection contact or a sensor can be present which, while the sabot is being moved in the direction of the end position, is mechanically and/or electrically actuated. In this way the third connection contact or sensor can serve as detection means for an effected tripping of the interruption switch. The third connection contact can be electrically connected to the first connection contact. In this way voltages can also be reduced via the third connection contact; in this respect see FIG. 9.

The third connection contact (also called center electrode) is preferably formed as a wire, rod or spring, preferably as a copper or brass wire/rod or copper spring, which preferably extends in the internal space formed by the first connection contact region along the longitudinal direction of the contact unit, and preferably reaches from the outer region of the interruption switch into the chamber surrounded by the upsetting region. In this way it can be guaranteed that, during the upsetting operation of the upsetting region, the upset upsetting region comes into contact with the rod, wire or spring of the third connection contact, whereby the first and the third connection contact can be connected to one another conductively. The use of a spring has the advantage that it works against the upsetting operation to a lesser extent than a stiff wire or rod. If the third connection contact is formed as a rod or wire, it is therefore preferred for its end projecting into the interruption switch to be split into at least two parts.

This so-called center electrode can be used to short-circuit, outside the separation point, the magnetic energy stored after disconnection of the connecting element in the inductance of the load circuit at the moment of switching and thus to relieve the separation point in energy terms; in this respect see FIG. 9.

However, this center electrode can also be used merely to give the superordinate system feedback about an assembly once tripped or a connecting element once opened.

A further embodiment of the present invention is also directed at an electrical interruption switch according to the invention—as described above—which has the third connection contact. In this embodiment, the interruption switch according to the invention can have no filling material in the combustion chamber or the further chamber. All (preferred) features in connection with the designs of the invention with a filling material can also be features of this further embodiment in which no filling material is present.

In a further embodiment of the present invention, the upsetting region can also be designed as a region which is solid, i.e. does not have a yet further chamber, i.e. in this case, although the sabot is exposed to pressure, it is stationary even after the ignition of the pyrotechnic material. Here, the sabot is referred to as impact element. All (preferred) features in connection with the designs of the invention with an upsetting region can also be features of this further embodiment (with the exception of the third connection contact) in which this region is present as a solid region.

All designs of the interruption switch of the invention which have a third connection contact can be used by energy per mass stored in the consumer (e.g. electric motor). The interruption switch is incorporated via the first and the second connection contact into an electric circuit, which has a current source and any desired consumer. Preferably, the first connection contact is connected to the any desired consumer and the second connection contact is connected to the current source. If the electric circuit is interrupted by the switching of the interruption switch, the stored energy in the consumer can result in the formation of an electric arc between the separated parts of the separation region of the interruption switch. If the third connection contact is connected to the other side of the any desired consumer than the first connection contact, the energy per mass stored in the consumer can be discharged in the case of switching of the interruption switch according to the invention through the connection forming between the first and the third connection contact. In this way the electric arc forming can be effectively "starved out", because hereafter the energy is short-circuited outside the separation point. This means that the third connection contact or the so-called center electrode is used as a short-circuit electrode in this case.

Alternatively, the interruption switch according to the invention with the third connection contact can also be used as a sensor for an interruption switch that has already been tripped. For this, only the resistance between the second connection contact and the third connection contact needs to be measured. If the resistance is about zero ohms, then the interruption switch has already been tripped. However, other sensing device designs (sensors) can also be used here in order e.g. to facilitate an isolated feedback signal.

To create an interruption switch which implements a series of multiple interruptions, the contact unit can have at least two partial contact units, which each have an upsetting region, a separation region and a sabot. The partial contact units can then each be formed such that, when the pyrotechnic material is ignited, each sabot is exposed to a gas pressure or shock wave generated by the gas-generating or shock wave-generating activatable material in such a way that the respective sabot in the casing is moved in a movement direction from a starting position into an end position and in the process the associated upsetting region is plastically deformed, wherein the respective separation region is completely separated, and in the end position of the respective sabot an insulation spacing is achieved between the separated ends of the respective separation region.

Such a series of multiple interruptions has the advantage that, during a simultaneously effected interruption operation, in each case only a proportional voltage is applied between the ends that are to be separated of the separation regions, and thus the energy converted in a partial electric arc is in each case correspondingly reduced, and thus the partial electric arcs can be damped more effectively and quickly.

In a preferred embodiment, two partial contact units are provided, and the contact unit and the casing are formed mirror-symmetrical relative to a center plane, wherein the separation regions and the sabots are preferably provided outside the upsetting regions arranged in between them. In addition to the serial separation, the advantage results that the mechanical movements proceed in opposite directions and thus at least largely compensate for one another outwards.

According to a design of the invention, each partial contact unit can be assigned a separate pyrotechnic material, and an actuatable device can be provided for the active and substantially simultaneous ignition of the separate pyrotechnic materials. As a result, it can be ensured in a simple manner that the advantage of the separation regions arranged in series, namely the occurrence of in each case only half the voltage at the ends of the separation regions during the shutoff operation, can also be utilized. It is therefore preferred that such a device has two combustion chambers inside two separation regions, which can both include the features described further above.

Outwardly, the interruption switch according to the invention is reactionless. No exhaust gases, no light and no plasma escape, the tripping noise is to be perceived only as a soft click, and the two electrical connections of the interruption switch can be firmly fixed, since no movement of one or the other connection is necessary for the function of the switch.

The casing itself can be provided as a tube with caps screwed in or crimped in on both sides, preferably comprising a pot-like part into which a cap is screwed together with the entire contact unit. The casing can also be formed in one piece if the material thereof can be easily reshaped, for example by crimping or bending. The casing can also be composed of several parts to form a one-piece casing, for example by adhesive bonding or welding of the individual parts.

An integral arrangement of one or more contact units in a superordinate collective casing or in a superordinate commercial assembly is also possible.

For example, the mini detonator or the tripping element can be completely screwed in as a priming screw, or else only inserted and then firmly connected to the contact unit at the end of the contact unit by rolling, clinching or crimping.

The interruption switches according to the invention are preferably covered with a so-called heat shrinkable tubing, which insulates externally and fits over the casing of the interruption switch. The heat shrinkable tubing can preferably consist of a well-insulating, preferably transparent, material, for example polyolefin. Thus, the casing/the assembly is protected against corrosion and the casing, which is metallic here in the examples, is simultaneously prevented from short-circuiting nearby live parts. Labels or inscriptions can thus also be durably protected and also durably protected against aggressive media.

Of course, the casing can also consist of a non-conductive material, for example ceramic, POM, PA6 or ABS. In all of these cases the use of a heat shrinkable tubing is superfluous.

Further designs of the invention are also described herein.

The invention is explained in more detail below with reference to the embodiments represented in the drawings. All features which are described in relation to a particular figure can also be transferred to the interruption switches of the other figures, provided this is technically possible:

Figure 9:
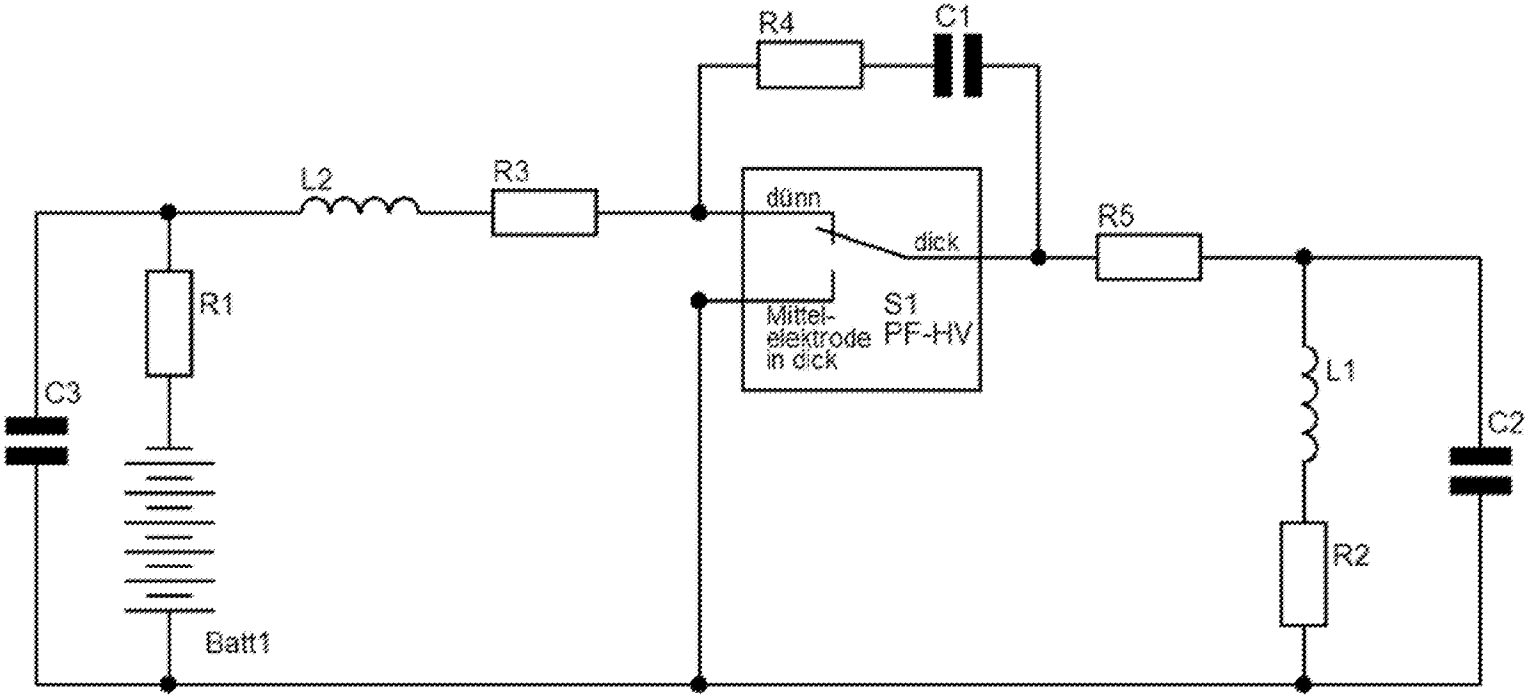
Figure 10:
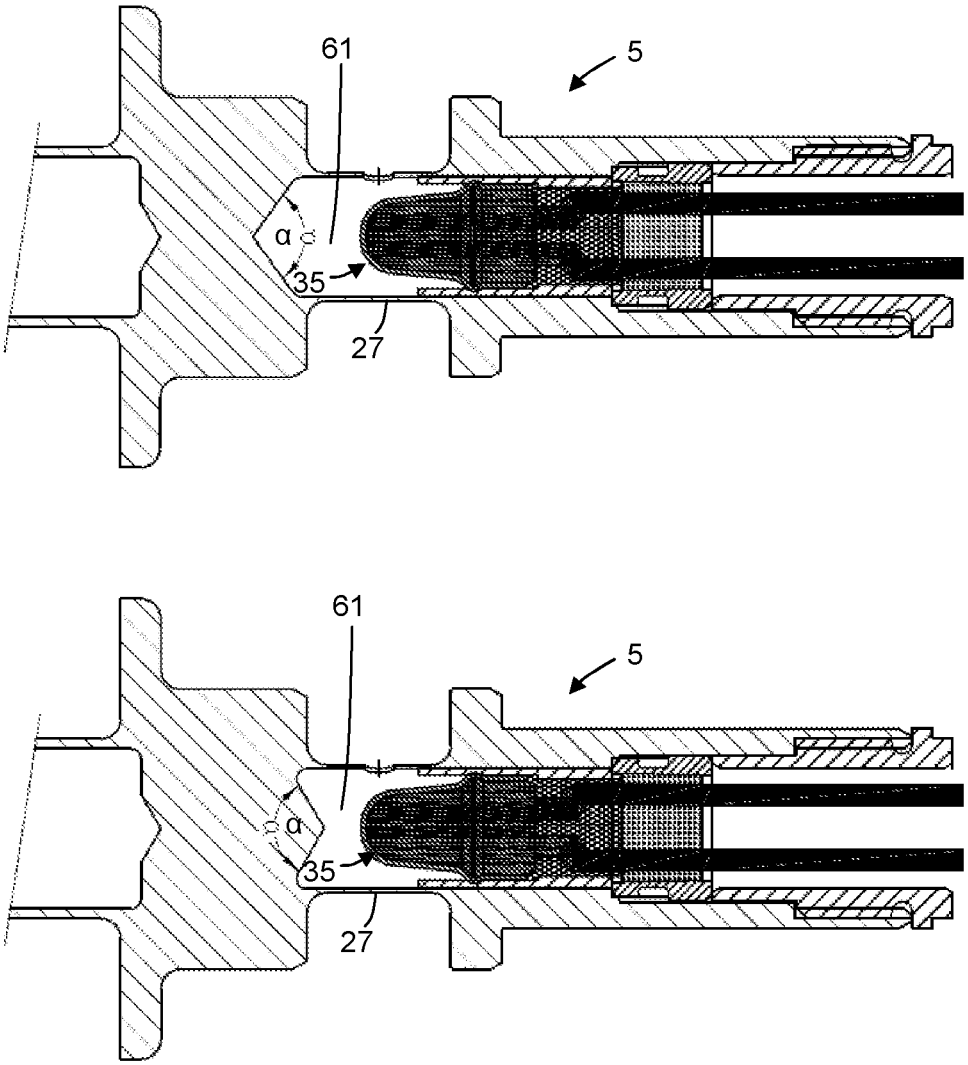
Figure 11:
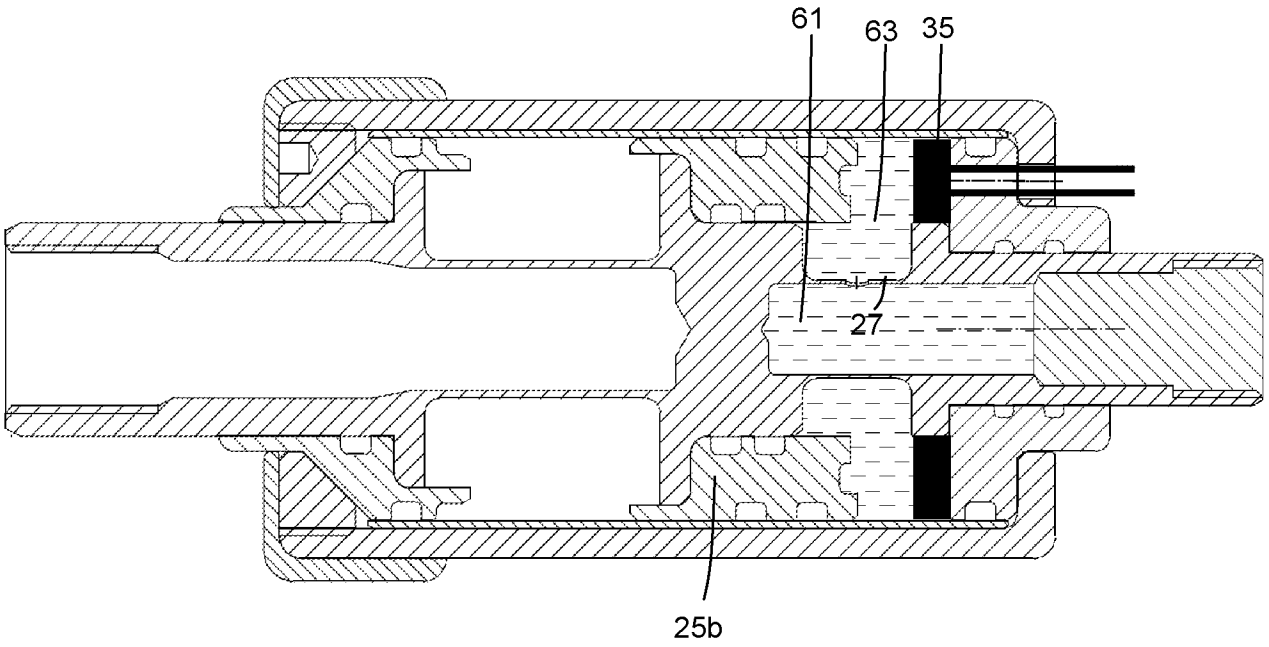
Figure 12:
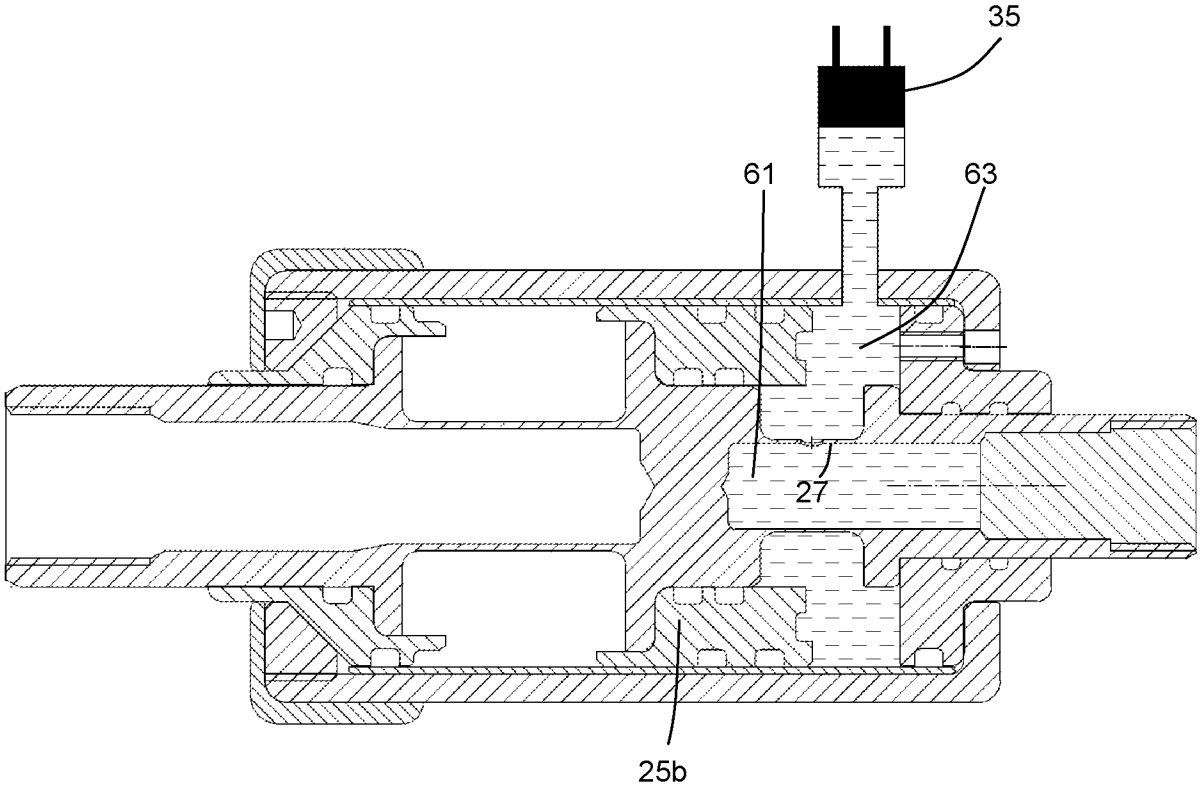
Figure 13:
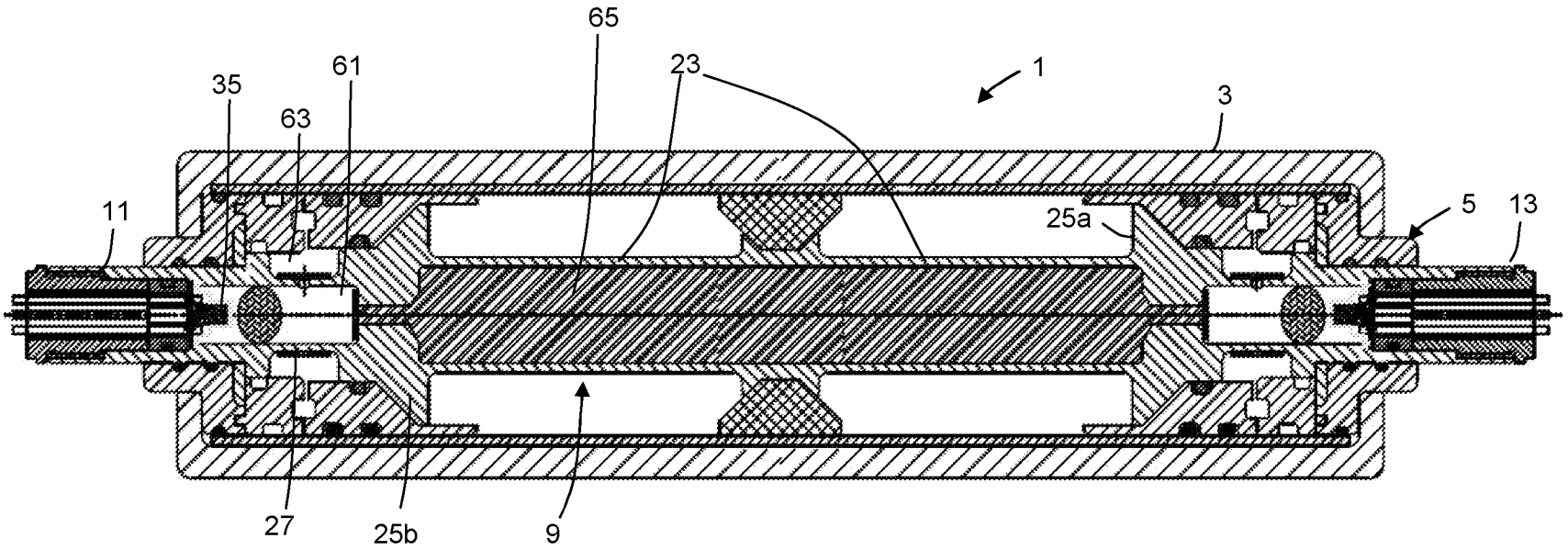
Figure 14:
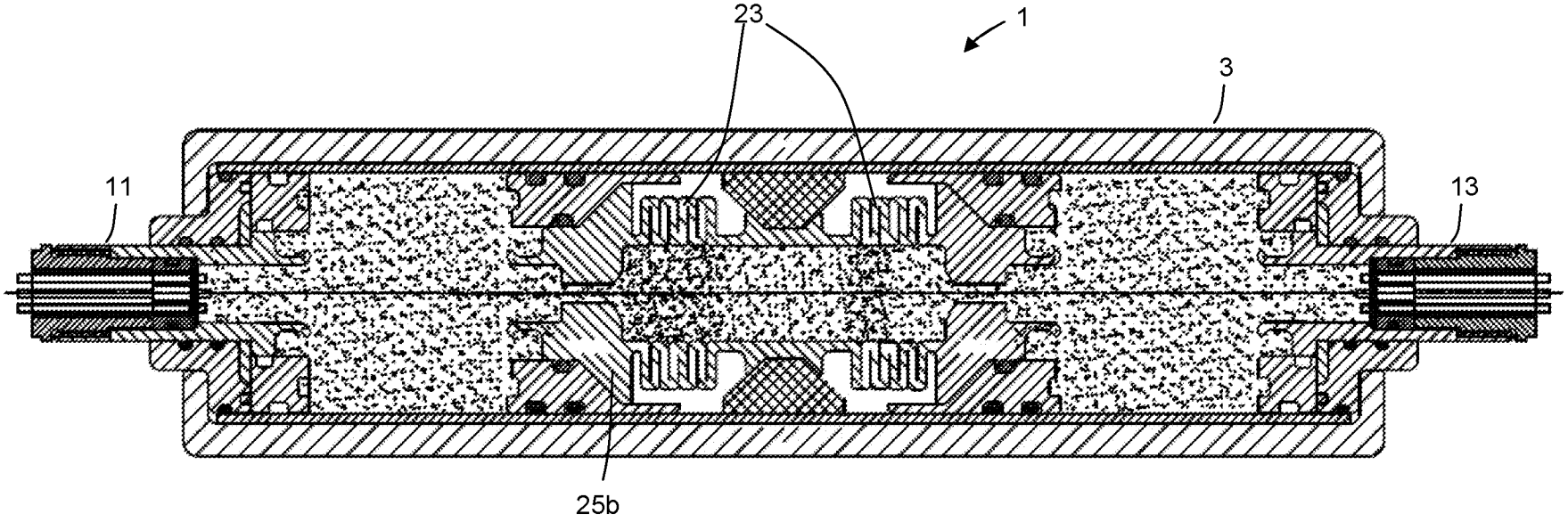

FIG. 9 shows by way of example the circuit diagram of an electric circuit with a current source (Batt 1) and any desired consumer R2, into which the interruption switch according to the invention is incorporated. The state of the interruption switch before it is tripped is shown; the first contact region (thick) is still connected to the second contact region (thin). From this, the action of the center electrode as short-circuit element can also be recognized, provided it is inserted;

FIG. 10 shows the possible design of the combustion chamber wall, lying opposite the mini detonator inserted here by way of example, for guiding shock waves: formed concave at the top, formed convex at the bottom; in place of the pointed cones shown, hollows or domes are also possible and useful;

FIG. 11 shows the introduction of the pyrotechnic material into the space via the previously thus-named combustion chamber or the switch separator; both volumes are here filled with filling material again;

FIG. 12 shows the depressing of the sabot or of the separation region through the reaction of the pyrotechnic material which is now housed outside the casing and in the case of which the pressure energy is introduced into the casing via a connecting tube;

FIG. 13 shows an interruption switch according to the invention before the pyrotechnic material is triggered, which is constructed mirror-symmetrical and thus has two separation regions and two upsetting regions on opposite sides;

FIG. 14 shows the interruption switch from FIG. 13 after the ignition device is tripped.

Figure 15:
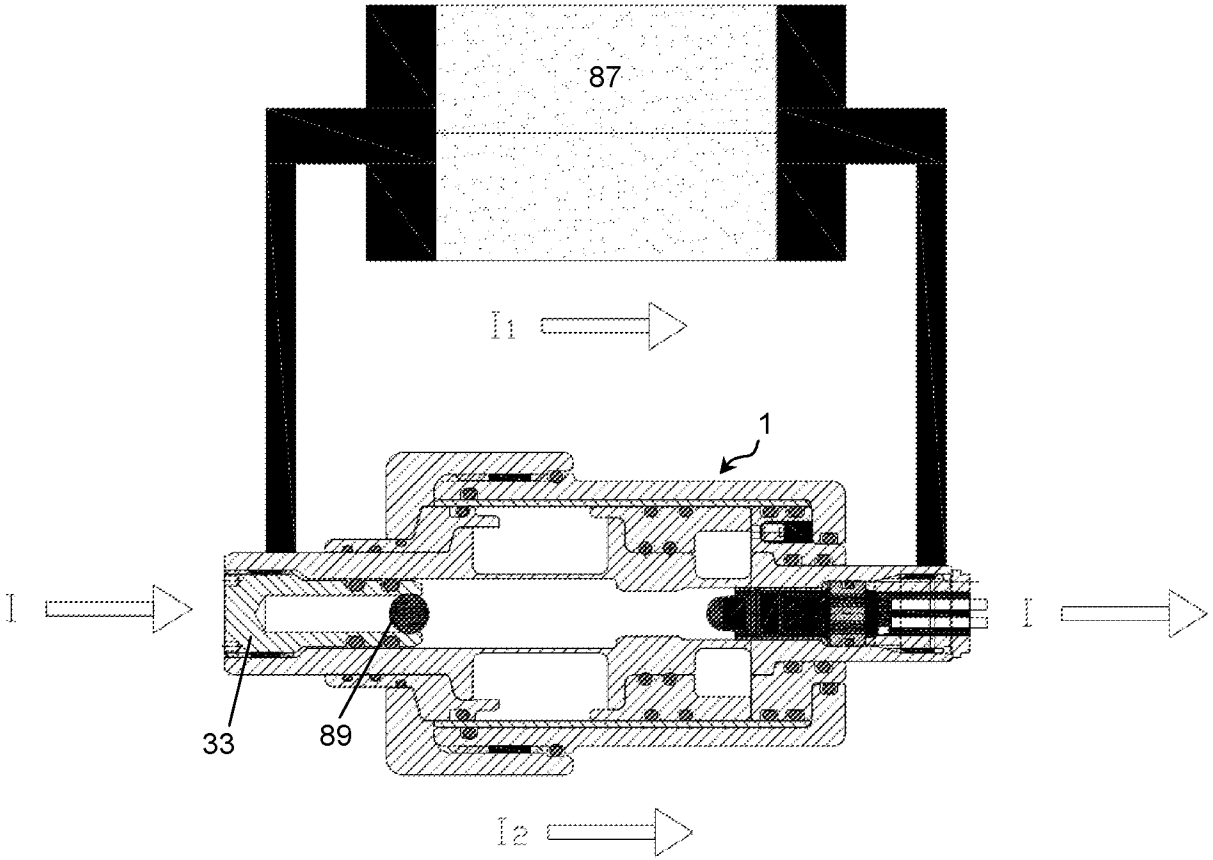

FIG. 15 shows an arrangement in which an interruption switch according to the invention is connected in parallel with a safety fuse.

Figure 16:
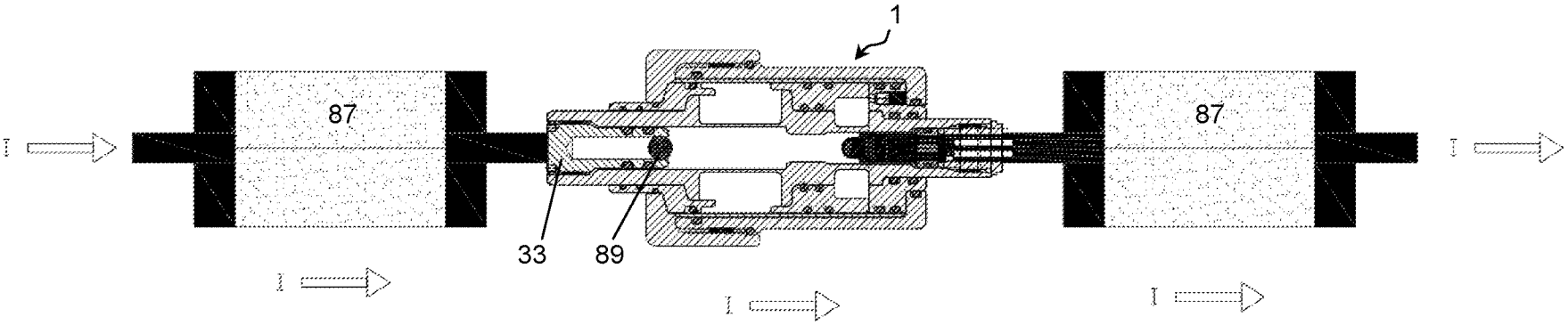

FIG. 16 shows an arrangement in which an interruption switch according to the invention is connected in series with two safety fuses.

Figure 17A:
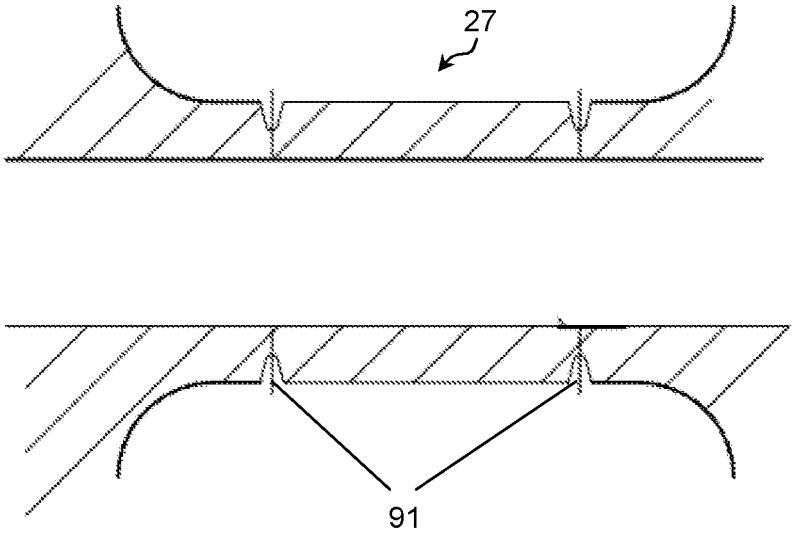

FIG. 17A shows a separation region of an interruption switch according to the invention with two circumferential grooves.

Figure 17B:
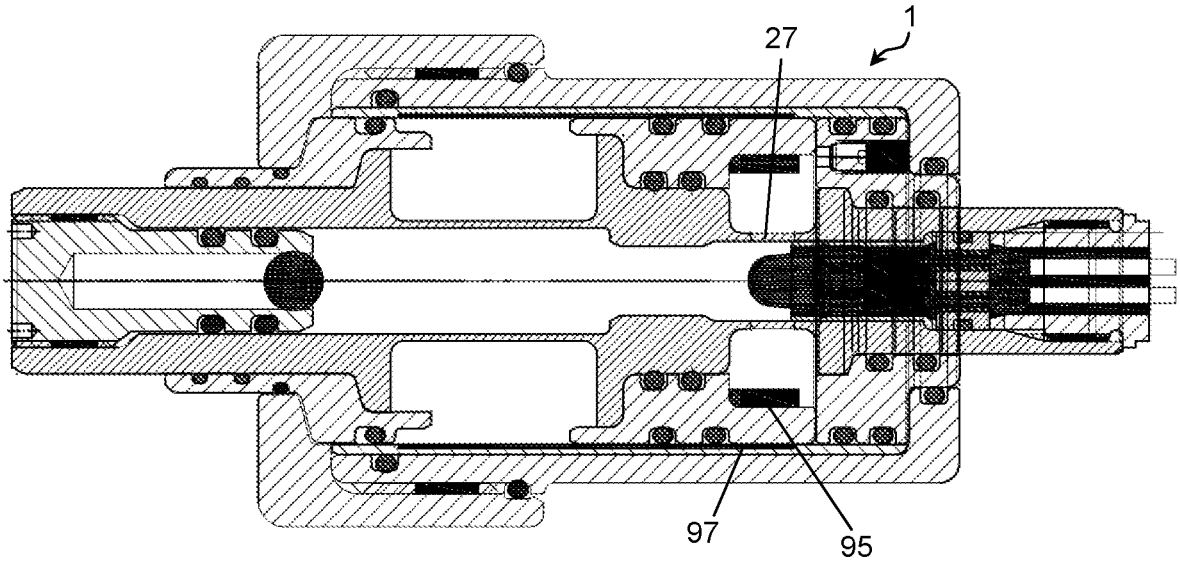

FIG. 17B shows an interruption switch according to the invention with a separation region according to FIG. 17A.

Figure 18A:
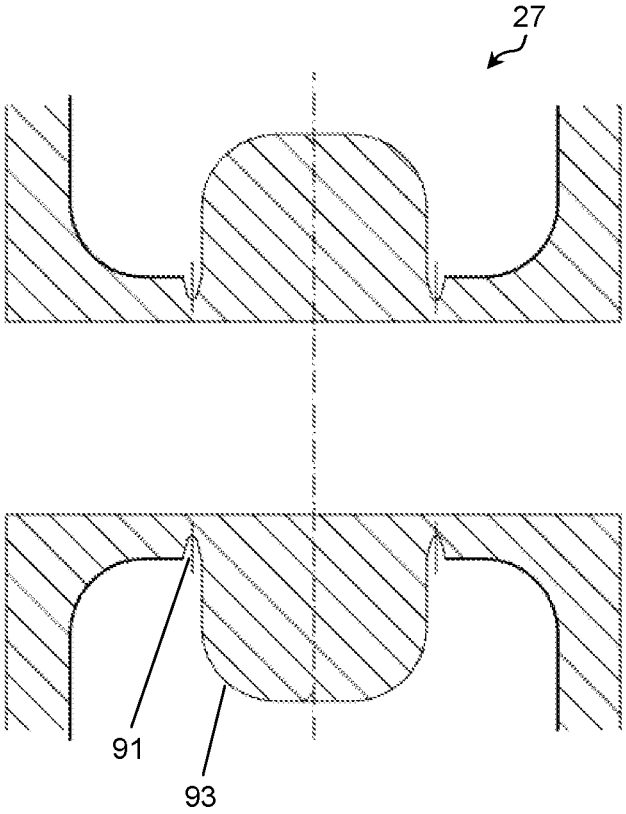

FIG. 18A shows a separation region of an interruption switch according to the invention with a circumferential thickening (small lump).

Figure 18B:
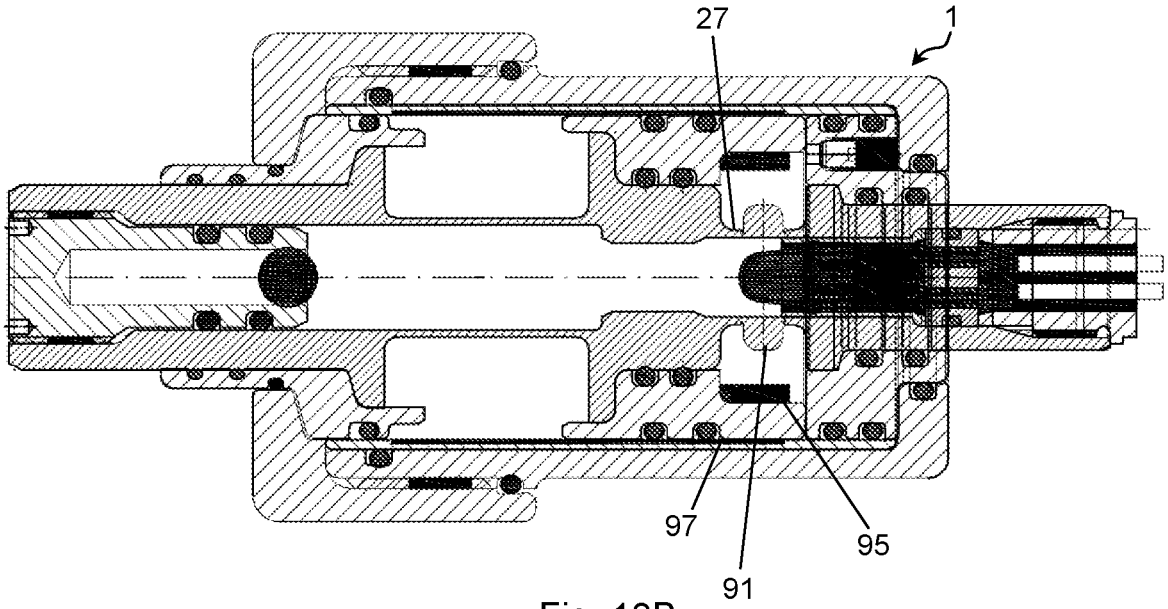

FIG. 18B shows an interruption switch according to the invention with a separation region according to FIG. 18A.

Figure 1:
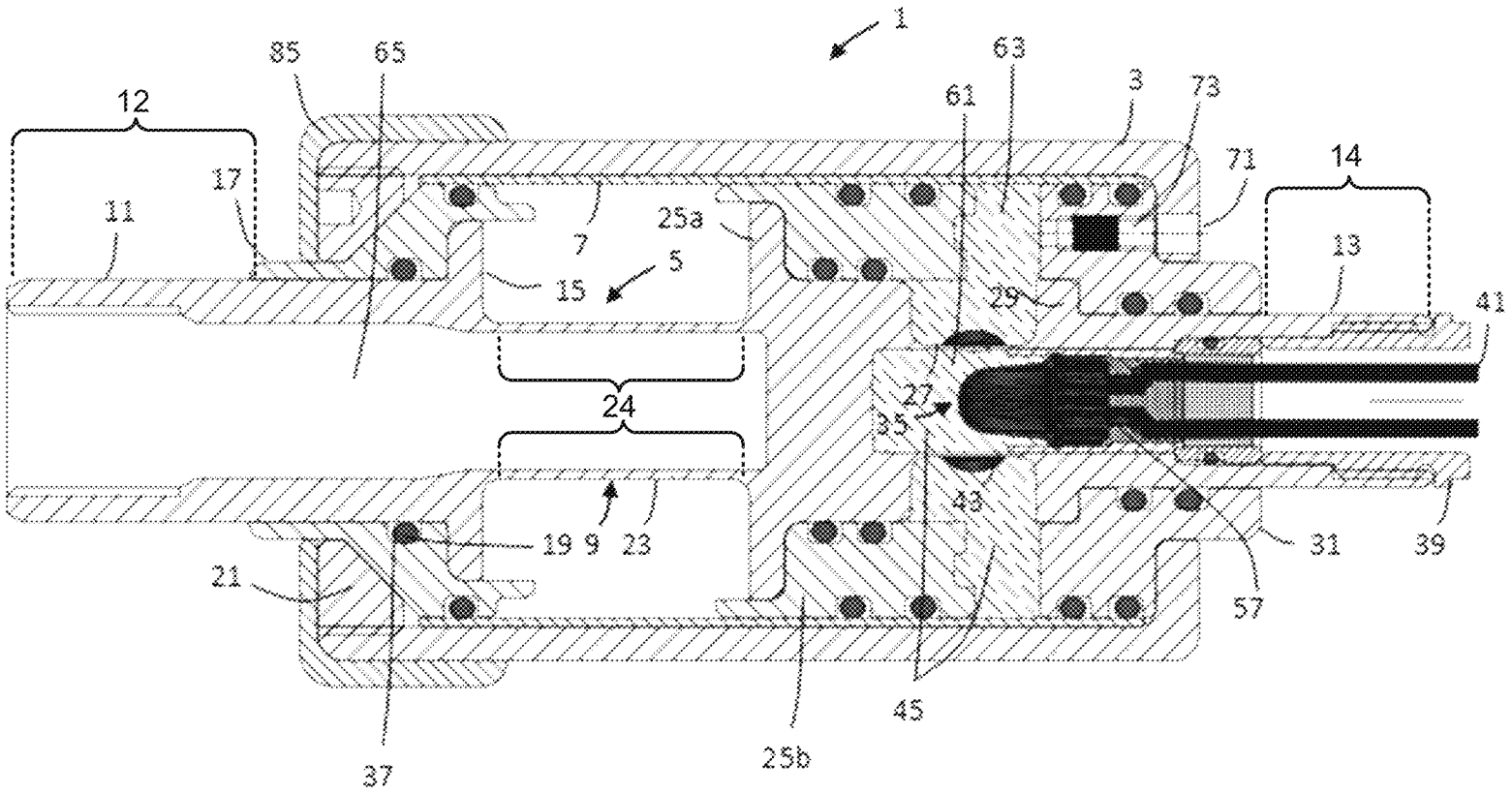
FIG. 1 shows a longitudinal cross-section through an interruption switch according to the invention in the initial state, wherein the connecting element does not have a channel, and the one chamber and the further chamber are filled with the filling material.

The embodiment of an interruption switch 1 according to the invention represented in FIG. 1 comprises a casing 3 in which a contact unit 5, also called connecting element, is arranged. The casing 3 is formed such that it withstands a pressure, generated inside the casing, which is generated in the case of a pyrotechnic tripping of the interruption switch 1, without the risk of damage or even bursting. The casing 3 can in particular consist of a suitable metal, preferably steel. In this case, an insulation layer 7 which consists of a suitable insulating material, for example a plastic, can be provided on the inner wall of the casing 3. Polyoxymethylene (POM) can be used here for example as plastic for this purpose. In the case of higher voltages, flashovers or an electrical contact between the contact unit 5, which of course consists of a conductive metal, for example of copper, and the casing 3 are hereby avoided, in particular during and after the tripping of the interruption switch 1. However, electrically non-conductive materials such as ceramic, POM, PA6 or ABS are also possible here as casing material, which, however, as a rule have to be suitably reinforced, for example by ribs. In these cases, the wall thickness of the casing 3 will also usually turn out to be thicker than in the case of a metallic casing.

The protective cap 85 shown in FIG. 1 is only present when the casing 3 is closed by a locking nut 21. When the casing is depressed after tripping the casing tube 3 would expand in diameter here (the flow of forces is interrupted here), and the screw thread would disengage here, and the assembly would thus burst. The protective cap 85 prevents this expansion and is omitted if the casing 3 is in one piece or is welded on both sides to the washer 21 and the closure 31 which are then present here.

In the embodiment example represented, the contact unit 5 is formed as a switch tube 9 depressed in the upsetting region by the sabot 25*b*, with the result that it is formed as a tube only in the separation 27 and the upsetting 23 region. In the embodiment example represented, the switch tube 9 has a first connection contact 11, in a first connection contact region 12, with a larger diameter and a second connection contact 13, in a second connection contact region 14, with a smaller diameter. Adjoining the first connection contact 11 is a flange 15 extending radially outwards, which is braced on an annular insulator element A 17, which consists of an insulating material, for example a plastic, in such a way that the switch tube 9 cannot be moved out of the casing 3 in the axial direction. The plastic used for this can be polyoxymethylene, ABS or nylon, but ceramics are also possible and in special cases are useful. For this purpose, the insulator element A 17 has an annular shoulder, on which the flange 15 of the switch tube 9 is braced. In addition, the insulator element A 17 insulates the casing 3 from the switch tube 9. The annular insulator element A 17, in an axially outer region, has an internal diameter which substantially corresponds to the external diameter of the switch tube 9 in the region of the first connection contact 11. As a result, a sealing action is achieved, which is strengthened by an additional annular sealing element 19, for example an O-ring. The insulator element A 17 can also be connected to the switch tube 9 via a press fit, or injection-molded onto it. The insulator element A 17 and thus the switch tube 9 or the contact unit 5 is held in the casing 3 on the respective end face of the interruption switch 1 by means of a locking nut 21 or a welded-in washer 21, or fixed in the casing 3 in this way. The locking nut 21 or the washer 21 can consist of metal, preferably steel. It is hereby also ensured that the switch tube cannot escape from the casing 3 if the plastic parts of the interruption switch 1 soften or burn, even if the interruption switch 1 is tripped again in this state. This is because the external diameter of the flange 15 is chosen to be greater than the internal diameter of the locking nut 21.

However, the casing 3 can of course also be reshaped on the end face represented on the left in FIG. 1 during the assembly of the interruption switch 1, in such a way that a part of the casing 3 extending radially inwards fixes the insulator element 17. If the casing 3 consists of plastic, the insulator element 17 can also be omitted.

The switch tube 9 has an upsetting region 23 adjoining the flange 15 in the axis of the switch tube 9, the upsetting region 23 of the switch tube 9 having a wall 24. The wall thickness of the switch tube 9 in the upsetting region 23, which has a predetermined axial extent, is selected and adapted to the material in such a way that, when the interruption switch 1 is tripped, as a consequence of a plastic deformation of the switch tube 9 in the upsetting region 23, the upsetting region 23 is shortened in the axial direction by a predetermined distance.

In the axial direction of the switch tube 9, a flange 25*a* follows the upsetting region 23 on which a sabot 25*b* is seated in the embodiment example represented. The sabot 25*b*, which in the embodiment example represented consists of an insulating material, for example a suitable plastic, engages around the switch tube 9 with its part 25*b* in such a way that an insulating region of the sabot 25*b* engages between the outer circumference of the flange 25*a* and the inner wall of the casing 3. If a pressure acts on the surface of the sabot 25*b*, a force is generated which compresses the upsetting region 23 of the switch tube 9 via the flange 25*a*. This force is chosen such that, during the tripping operation of the interruption switch 1, upsetting of the upsetting region 23 occurs, wherein the sabot 25*b* is moved out of its starting position (status prior to the tripping of the interruption switch 1) into an end position (after the completion of the switching operation).

As can be seen from FIG. 1, the sabot part 25*b* can be chosen such that its external diameter substantially corresponds to the internal diameter of the casing 3, with the result that an axial guidance of the flange 25*a* and thus also an axially guided upsetting movement is achieved during the switching operation.

After the pressing operation, the lugs of the insulator 17 and of the sabot 25*b* lying near the casing 3 engage over each other completely, with the result that the upsetting region 23, which has been pushed together in a meandering fashion after the tripping and the upsetting operation, is completely surrounded by electrically insulating materials.

Adjoining the sabot 25*b* or the flange 25*a* of the switch tube 9 or of the contact unit 5 is a separation region 27 which in turn is preferably adjacent to a flange 29 of the switch tube 9 in the axial direction. The second connection contact 13 of the switch tube 9 then follows the flange 29. The flange 29 in turn serves to fix the switch tube 9 or the contact unit 5 securely in the casing 3 in the axial direction. This purpose is served by an annular region of the casing 3 (not provided with a reference number) extending radially inwards and a closure 31, which is provided between a corresponding stop face of the flange 29, the inner wall of the end-face annular region 3*a* of the casing 3, and the axial inner wall of the casing 3 and which annularly engages around the second connection contact of the switch tube 9. The flange 29 can—as shown in FIG. 1—engage in the closure 31 in the axial direction. As an alternative to this it can also be placed on the closure 31 in the axial direction (see FIGS. 3 to 6). The closure 31 can consist of metal, in particular steel.

If the closure 31 does not consist of a metal or a ceramic but rather of a plastic, a metal disc with a diameter which is greater than the right-hand opening of the casing must be introduced after the flange 29 in order, in the event of fire—in the event of fire the plastic parts are no longer there of course—to prevent parts from escaping from the casing.

If the casing 3, the closure 31 and the locking nut/washer 21 are made of steel, it is possible to join these parts to each other by electron-beam or ultrasonic welding. Joining by laser beam is also possible.

In the embodiment example represented, during the assembly of the interruption switch 1, the sabot 25*b* is pushed onto the switch tube 9 from the side of the connection contact 13 and must therefore be dimensioned such that its internal diameter is greater than or equal to the external diameter of the flange 29.

The closure 31 is designed as an annular component, which has an external diameter which substantially corresponds to the internal diameter of the casing 3, and an internal diameter which substantially corresponds to the external diameter of the flange 29 or the second connection contact 13.

An ignition device 35 with pyrotechnic material, often also called mini detonator or priming screw here, is provided in the axial end of the switch tube 9 in the region of the second connection contact 13. The external circumference of the ignition device 35 is sealed off from the inner wall of the switch tube 9 or of the second connection contact 13 by a sealing element (dark circular element in recess), for example an O-ring. To axially fix the ignition device 35, a small shoulder can be provided in the inner wall of the switch tube 9 or of the second connection contact 13, wherein during the assembly of the interruption switch 1 the ignition device is pushed into the switch tube 9 as far as the shoulder. To axially fix the ignition device 35, a locking element 39 is then screwed into the second connection contact 13. The electrical connection lines 41 of the ignition devices 35 can be passed outwards through an opening in the annular closure 31. For complete sealing and fixing, the interior of the locking element 39 can be potted, in particular with a suitable epoxy resin. This then serves simultaneously to relieve strain on the connection lines 41. In the region where the connection lines 41 enter the ignition device 35, the connection lines can be fixed using a potting compound 57. In FIG. 1, the locking element 39 is provided with a screw thread in order that it can be screwed into the second connection contact 13 of the switch tube 9 but later, if the assembly is implemented in series, for cost reasons it is merely pushed into the second connection contact 13, preferably formed as a tubular part, and then crimped in, clinched or curled.

The closure 31 can consist of a metal, in particular steel. This has the advantage of the connection of potential between the casing 3 and the second connection contact 13. In this way "the casing knows where it belongs with respect to the potential". The latter is important in high-voltage circuits in order not to obtain any undesired electric arcs with parts having no connection of potential. In addition, the casing 3 shields the inner region of the interruption switch 1 from electromagnetic radiation, e.g. a radar beam.

The separation region 27 is dimensioned such that it at least partially tears open due to the generated gas pressure or the generated shock wave of the mini detonator 35, with the result that the pressure or the shock wave can also propagate out of the one chamber (combustion chamber 61) into the further chamber 63 designed as a surrounding annular space. To facilitate the tearing open, the wall of the switch tube 9 can also have one or more openings or holes in the separation region 27. In addition, an ignition mixture 43 can also be provided in the separation region 27 on the side of the further chamber 63. The openings and the ignition mixture are preferably covered with a protective lacquer 55 (shown by way of example in FIG. 5). The ignition mixture 43 can also be covered with a layer of natural rubber to protect against the influences of the filling material. In the event that the actuation of the mini detonator 35 fails, the ignition mixture 43 can serve to bring about a passive shutting off, i.e. to separate the separation region 27, without the ignition device 35 having been actively tripped: in the case of excess current, the center part of the separation region 27 in particular heats up very strongly and very quickly and in the process ignites the ignition mixture when the ignition temperature is reached, which then again suitably ignites the ignition device 35 or the pyrotechnic material with it.

The ignition mixture 43 can likewise already be a priming charge, which already generates a shock wave on its own when heated to its ignition temperature and thus already tears open the separation region—now inwards here—and then depresses the sabot. In this case, it would therefore not be necessary at all for the ignition device 35 or the mini detonator to act or ignite as well. If it is not desired to trip the assembly actively, this priming charge would already also be sufficient to sever the switch separator and to upset the upsetting region 23 of the switch tube 9.

The ignition device 35 for igniting the pyrotechnic material (ignition device) can consist of a simple, rapidly heatable glow wire. The activation of the ignition device can be effected by a corresponding electrical actuation. However, the ignition device 35 can of course also be formed in any other desired way which brings about an activation of the pyrotechnic material, also in the form of a conventional igniter, an ignition tablet, a squib or a mini detonator.

In addition or instead, a passive activation of the interruption switch 1 can be provided. For this, the increase in temperature of the material of the switch tube 9 in the separation region 27 is utilized. In this case, there should be as direct a contact as possible between the pyrotechnic material and the inner wall and/or outer wall of the switch tube 9 in the separation region 27. In addition, a more easily activatable material, in particular an ignition mixture or priming charge 43, can also be provided in close proximity to or applied to the inner wall and/or outer wall of the separation region.

FIG. 1 shows such a layer of an ignition mixture 43 which is applied in paste form to the outer wall of the separation region. If a filling material is poured in, this ignition mixture must be protected from the filling material on all sides, for example by a layer of epoxy resin or natural rubber.

The electrical resistance and thus also the thermal behavior of the separation region 27 can be influenced by the provision of openings in the wall of the separation region 27 (in conjunction, of course, with the wall thickness of the separation region and the dimensioning of the radii at the transitions of the separation region, which substantially determine the heat outflow from the separation region and its rupturing behavior). As a result, the current-time integral at which the interruption switch 1 trips passively can be defined or set. The inertia can also be influenced by such a dimensioning.

In the case of an activation of the interruption switch 1 by means of the ignition device 35 or by means of a passive activation, a pressure or a shock wave is thus generated on the side of the sabot 25*b* facing away from the upsetting region 23, as a result of which the sabot is exposed to a corresponding axial force. This force is chosen by a suitable dimensioning of the pyrotechnic material such that in the upsetting region 23 the switch tube 9 is plastically deformed, torn open or caved in, and then the sabot is moved in the direction of the first connection contact 11. The pyrotechnic material is dimensioned such that, after the breaking open or caving in of the separation region 27 of the switch tube 9, the sabot 25*b* is moved into the end position represented in FIG. 6.

Immediately after the activation of the pyrotechnic material, the separation region 27 is therefore at least partially torn open or caved in. If the tearing open or caving in does not already take place before the start of the axial movement of the sabot 25*b* over the entire circumference of the separation region 27, a remaining portion of the separation region, which causes another electrical contact, is completely torn open by the axial movement of the sabot 25*b*.

Depending on the dimensioning of the separation region and of the pyrotechnic material, it is also conceivable that the separation region initially does not tear open after the activation but rather that the gas pressure acts only through corresponding openings in the wall of the separation region, also in the annular region surrounding the separation region 27. The tearing open of the separation region 27 can then be effected substantially only by the axial force on the sabot 25*b*, which also leads to the axial movement thereof.

The breaking open behavior can also be further controlled by corresponding choice of the pyrotechnic material and optionally of the ignition mixture comprised of it.

In particular, the gas pressure generated by the burn-off or the shock wave generated can be well controlled by introducing readily gasifiable liquids or solids into the space in which the pyrotechnic material is contained or into which the hot gases generated penetrate. Thus, in particular water, in solution with the filling material or in the form of microcapsules, gels etc., increases the gas pressure considerably. An increase in the gas pressure brought about in this way can turn out to be even more extreme if the water introduced into the combustion chamber is superheated, in particular because the strongly heated water experiences explosive decompression when the separation region 27 breaks open.

In the embodiment shown in FIG. 1, there is located in the combustion chamber 61 and in the further chamber 63 a filling material 45, which supports the propagation of the shock wave in the case of the detonation or deflagration of the pyrotechnic material, with the result that in this way less activatable material has to be used and the walls of the separation region 27 can be kept thick enough that the assembly can still be used even with high operating currents. The filling material is preferably at the same time an extinguishing material, with the result that, after the interruption switch has been switched, it can attenuate and cool or extinguish the formation of an electric arc—if not completely prevent it—between the separated ends of the separation region 27.

For inserting the filling material 45 into the further chamber 63, the interruption switch can have a casing hole 71 and a threaded hole 73, wherein the threaded hole 73 is present in the closure 31 and follows the casing hole, with the result that a passage is present through the casing and the closure 31 from outside into the further chamber 63. After the further chamber has been filled, the holes are closed for example with a screw. Of course, these openings can also be closed by another conventional method, such as e.g. pressing in a ball, by soldering or welding shut. Through the use of a membrane here, a type of overload valve could additionally be created, which opens when the assembly is overloaded, i.e. when the pressure builds up too strongly in the casing 3, before the casing 3 is destroyed. In this case, more than one hole or membrane would possibly also be provided in the closure in order to ensure the escaping mass flow of fluid and gas necessary in the event of overloading. In other words, the interruption switch according to the invention can therefore have an overload valve, which is provided between the exterior of the casing 3 and the further chamber 63.

Figure 2:
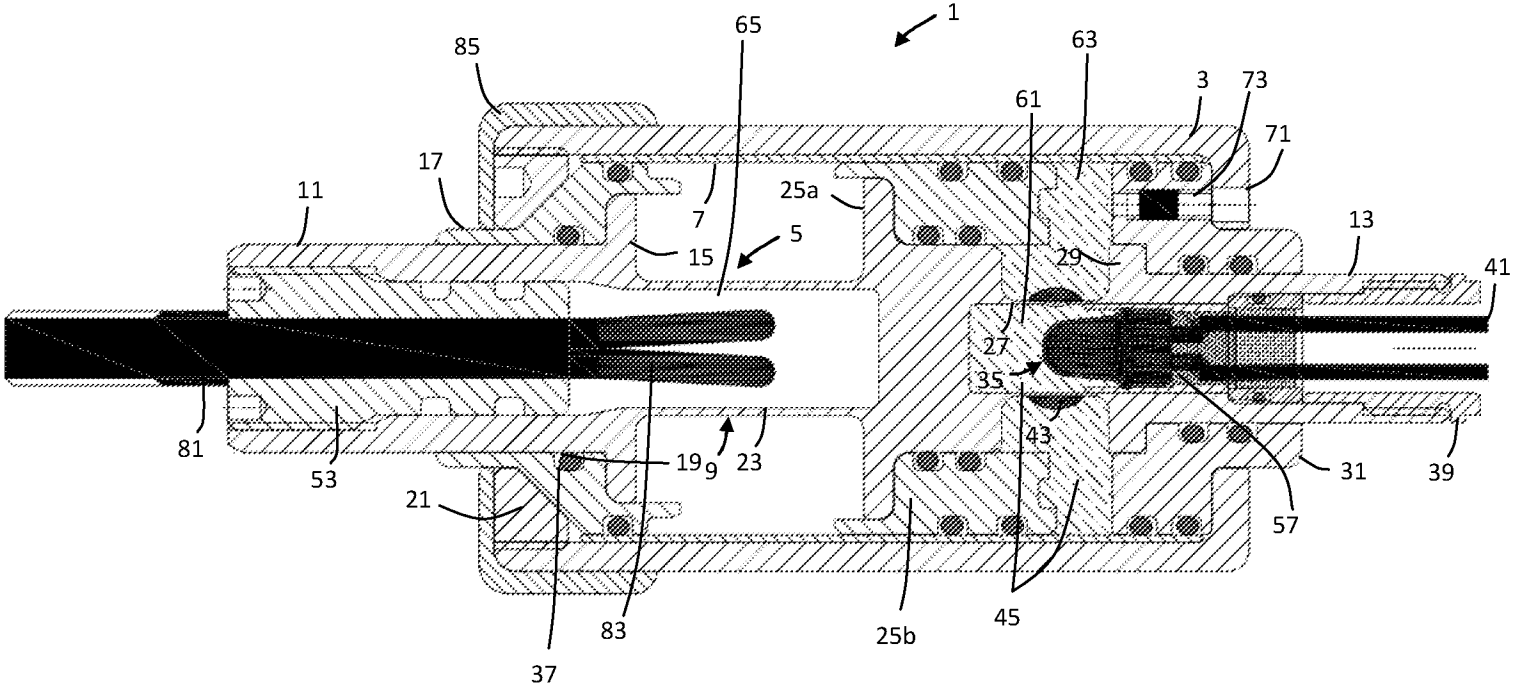
FIG. 2 shows a longitudinal section through an interruption switch according to the invention in the initial state, as in FIG. 1, wherein a third connection contact, the so-called center electrode, is provided in the first contact region.

FIG. 2 shows an interruption switch 1 according to the invention, which is substantially identical to the interruption switch 1 in FIG. 1, but has, inside the switch tube 9 on the axial side facing the first connection contact 11, an insulator element B 53 as filling piece, through which a third connection contact 81, the so-called center electrode, which preferably has a fanned out or split end 83, can be passed from the outer space of the interruption switch into the yet further chamber 65. The insulator element B 53 also serves as closure for the yet further chamber 65. The insulator element B 53 is preferably formed as a cylindrical part. The insulator element B 53 can be made of a plastic, such as for example PEEK, polyoxymethylene, ABS or nylon. The cylindrical insulator element B 53 is pressed into the hollow-cylindrical first connection contact 11. The insulator element B 53 preferably has recesses 37 for receiving sealing elements, which bring about a sealing between the axial outer wall of the insulator element B 53 and the inner wall of the first connection contact 11. In the embodiment shown in FIG. 2, the combustion chamber 61 and the further chamber 63 are filled with the filling material 45, while the yet further chamber 65 is not filled with filling material 45. However, it is also conceivable according to the invention to also fill the yet further chamber 65 with the filling material 45. It is also conceivable according to the invention that none of the chambers 61, 63 and 65 is filled with a filling material 45. It is also conceivable that, in place of the center electrode 81, only a sealing screw (not shown) is used.

Figure 3:
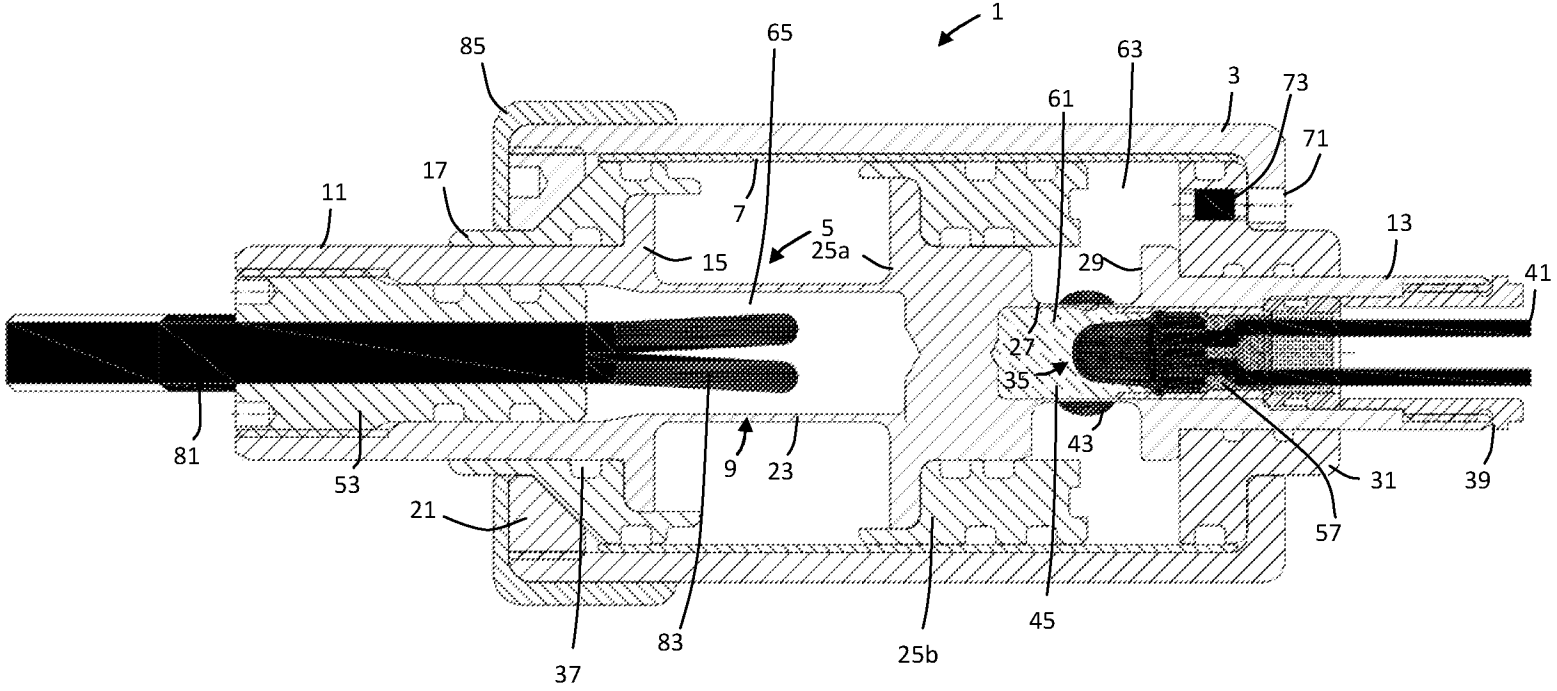
FIG. 3 shows a longitudinal section through an interruption switch according to the invention in the initial state with a third connection contact, wherein the connecting element does not have a channel, and only the combustion chamber is filled with the filling material.

FIG. 3 shows an interruption switch 1 according to the invention which is constructed substantially identical to the interruption switch 1 of FIG. 2. In the embodiment shown in FIG. 3 only the combustion chamber 61 is filled with the filling material 45. In contrast to the embodiment shown in FIG. 2, no filling material 45 is located in the further chamber 63. If the separation region 27 is torn open as a result of the detonation or of the deflagration of the pyrotechnic material, the filling material 45 can spread out of the combustion chamber 61 also into the yet further chamber 65. In this way, the filling material 45 can also act as extinguishing agent and prevent or at least greatly impede the formation of an electric arc between the two separated ends of the separation region 27. For the sake of completeness it may also be mentioned that the flange 29 in the embodiment shown in FIG. 3 is placed on the closure 31 and is not present countersunk as in the embodiment of FIG. 2.

Figure 4:
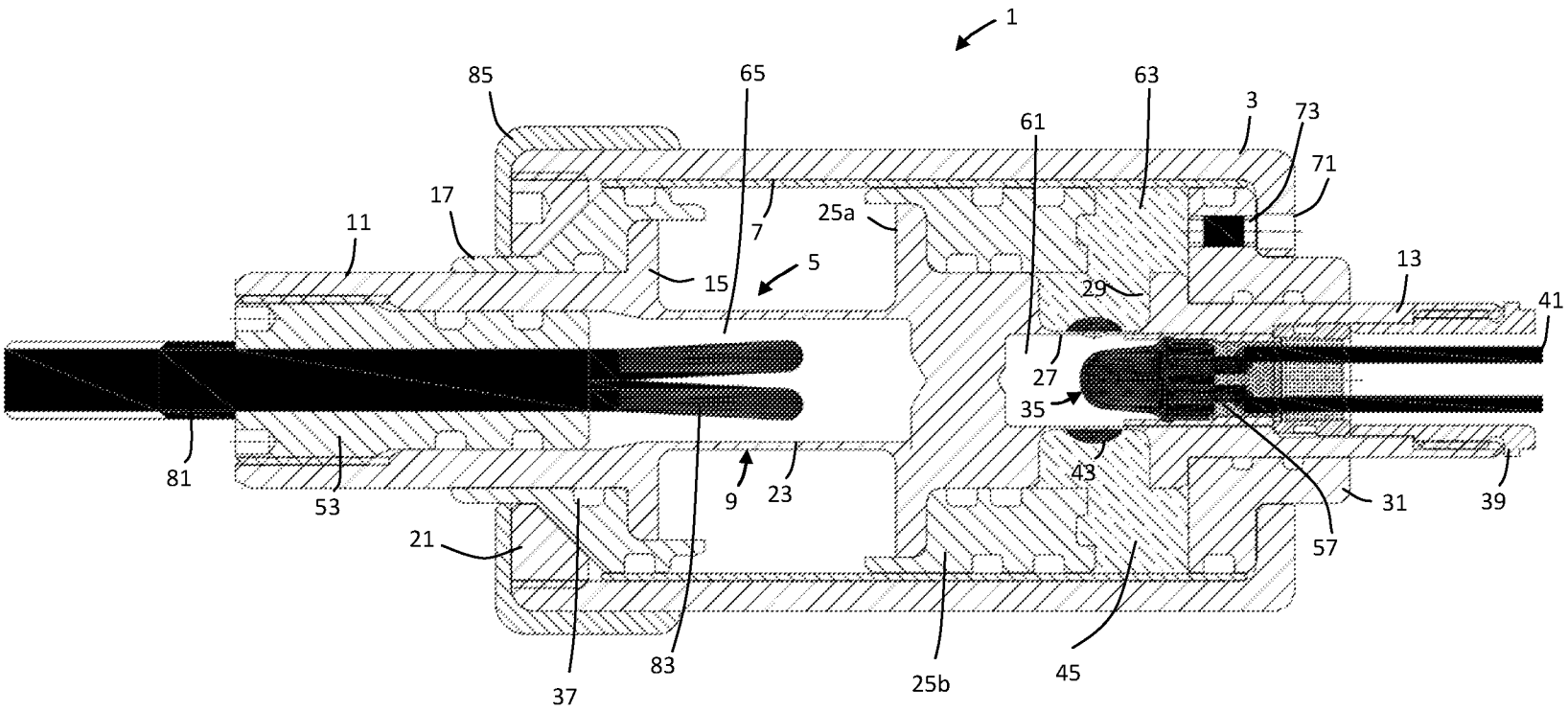
FIG. 4 shows a longitudinal section through an interruption switch according to the invention in the initial state with a third connection contact, wherein the connecting element does not have a channel, and only the further chamber is filled with the filling material.

The embodiment shown in FIG. 4 is substantially identical to the embodiment shown in FIG. 3 with the only difference being that no filling material 45 is present in the combustion chamber 61, but filling material 45 is present only in the further chamber 63. Here, as a result of the detonation or the deflagration of the pyrotechnic material, there is a build-up of pressure in the combustion chamber 61, with the result that the separation region 27 is completely or partially torn open in the direction of the further chamber 63, with the result that a shock wave, which acts on the sabot 25*b*, can then propagate through the filling material 45. At the same time, filling material 45 can also penetrate into the region of the combustion chamber 61, with the result that it can serve as extinguishing agent for preventing or impeding an electric arc between the separated ends of the separation region.

Figure 5:
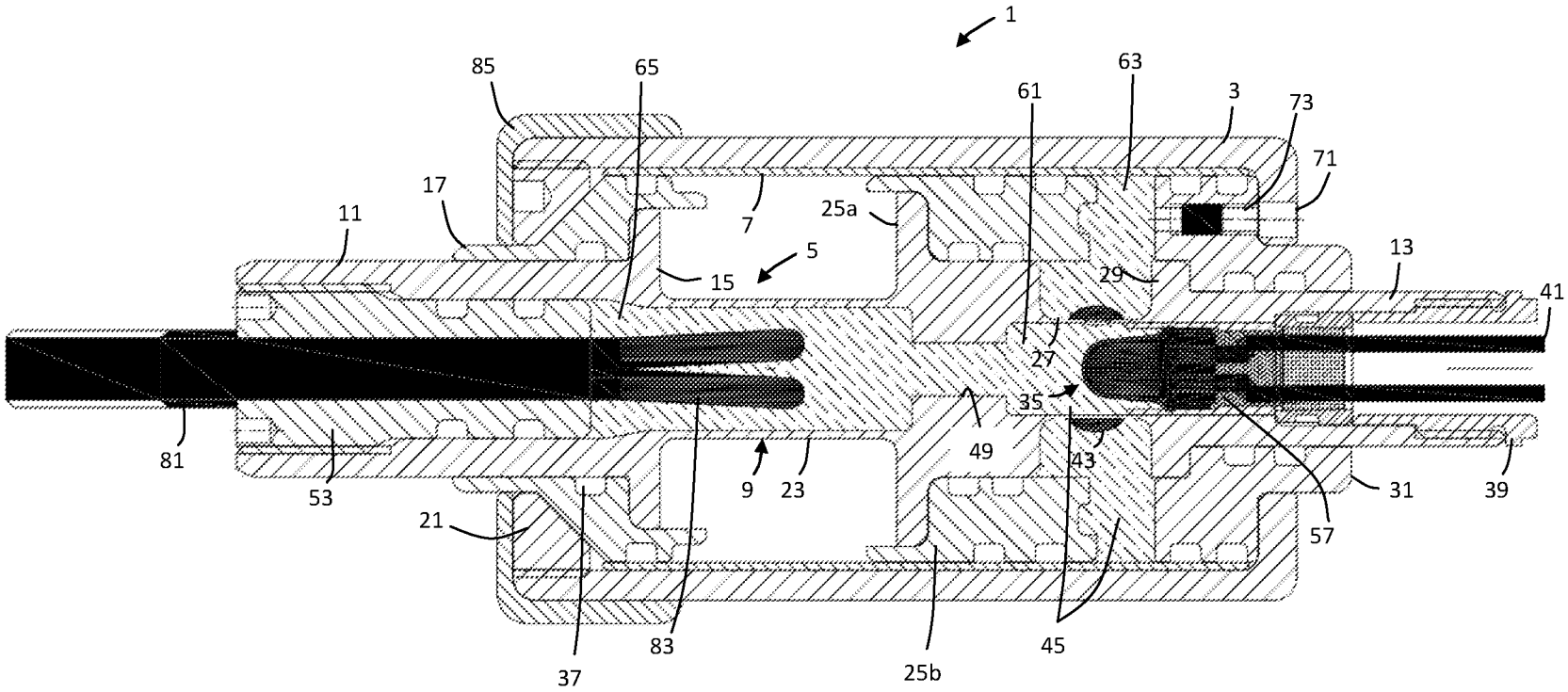
FIG. 5 shows a longitudinal section through an interruption switch according to the invention in the initial state with a third connection contact, wherein the connecting element here has a channel, and both the one chamber, the further chamber, the channel and the tube of the upsetting region (the yet further chamber) are filled with the filling material.

The embodiment shown in FIG. 5 shows an interruption switch 1 according to the invention, which has a channel 49 of the contact unit 5, which extends underneath the sabot 25*b*, in particular in the flange 25*a*, preferably centrally in the axial direction, and connects the combustion chamber 61 to the yet further chamber 65. In the embodiment example represented, the contact unit 5 is thus formed further as a continuous switch tube 9. In this embodiment, the combustion chamber 61, the channel 49, the yet further chamber 65 and the further chamber 63 can all be filled with the filling material 45. All further designs of the embodiment shown in FIG. 5 are substantially identical to the embodiments shown in FIGS. 2 to 4. The channel 49 ensures that, when the interruption switch 1 is tripped and during the associated movement of the sabot 25 from the starting position into the end position, the increasing volume in the region of the combustion chamber 61 and the further chamber 63 is also refilled with filling material 45. Through the movement of the sabot 25 from the starting position into the end position, filling material 45 in the yet further chamber 65 is compressed and injected through the channel 49 in the direction of the region of the combustion chamber 61 and here directly onto the separation point 27. In this way it is ensured that an electric arc between the separated parts of the separation region 27 does not form or is at least greatly damped.

Figure 6:
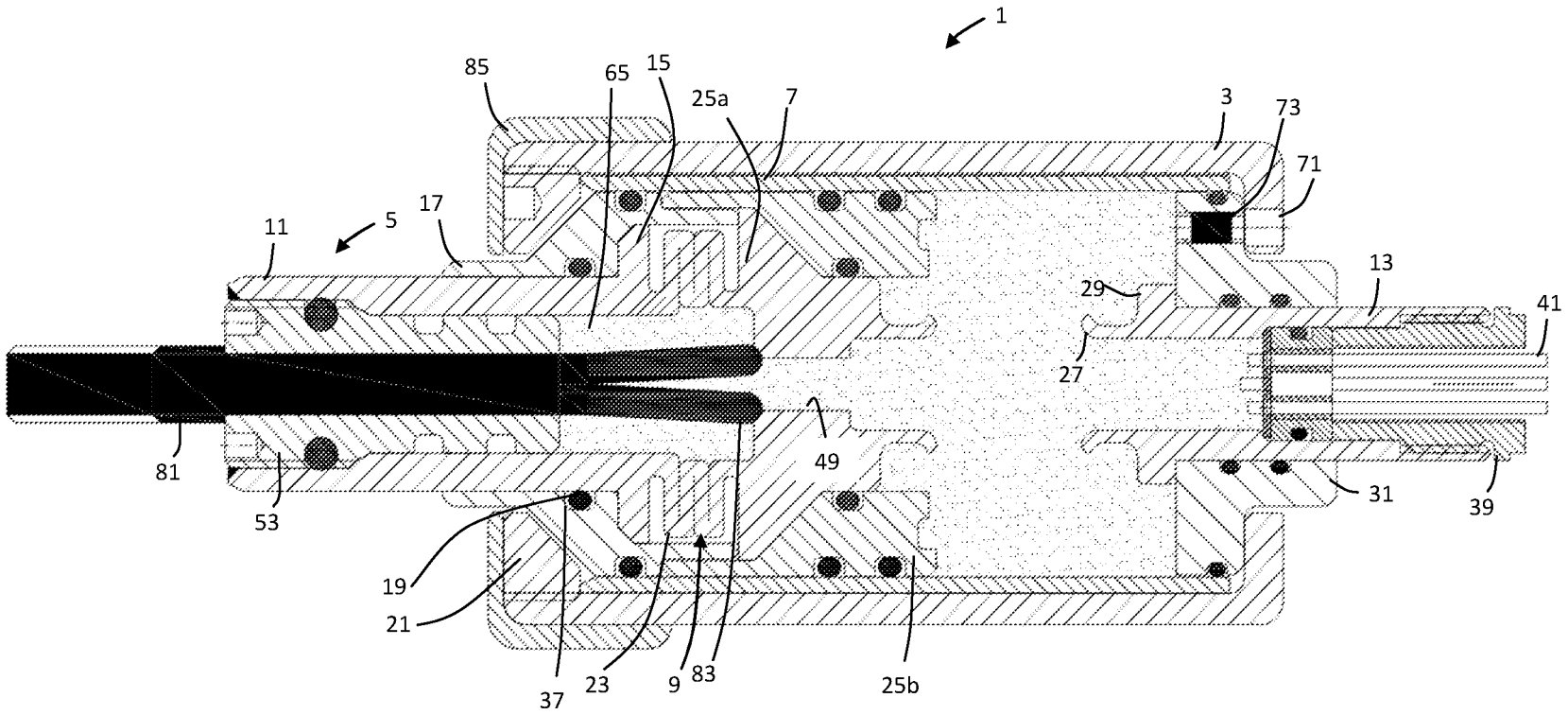
FIG. 6 shows a longitudinal section through the embodiment in FIG. 5 in the tripped state; the separation region is torn open, the sabot has pushed the tube of the upsetting region together in a meandering fashion and thus greatly enlarged the separating distance between the two contact points of the separation region.

As can be seen from FIG. 6, which represents the end state of the contact unit 5 or of the switch tube 9 after a tripping of the interruption switch 1, the upsetting region 23 of the contact unit 5 is preferably formed such that the wall of the contact tube 9 is folded in a meandering fashion in the upsetting region 23. The meandering folding is preferably to be effected predominantly outside the yet further chamber 65 in order to avoid a folded region being placed in front of the inlet opening of the channel 49 and preventing the filling agent 45 from being squeezed out. The folding in a region outside the receiving volume is however preferred in any case because of the internal pressure of the filling agent 45 that results during the upsetting of the switch tube 9, without additional measures needing to be provided for this, such as predetermined kinking points or the like. However, the desired folding properties can of course be generated or optimized by such additional measures. In particular, predetermined kinking points can be introduced on the outer and/or inner wall by corresponding structuring of the upsetting region 23. The axial projections of the insulator element A 17 and of the second sabot part 25*b* that engage in each other in the end state are also formed with respect to their axial length such that, during the upsetting operation and in the end state, they prevent the radially outer parts of the folded region of the wall of the switch tube 9 from touching the inner wall of the casing 3. Damage to the insulation layer 7 is hereby prevented if such an insulation layer is provided on the inner wall of the casing 3.

In variants without such an insulation layer 7, a metallic casing 3 is also hereby prevented from inadvertently being set at the same electrical potential as the first connection contact 11 after the tripping.

FIG. 6 shows the end state of an interruption switch according to FIG. 5 only by way of example. Apart from the slight changes in the construction (absence of the channel 49), the end state of the interruption switches according to FIGS. 2 to 4 is identical.

Figure 7:
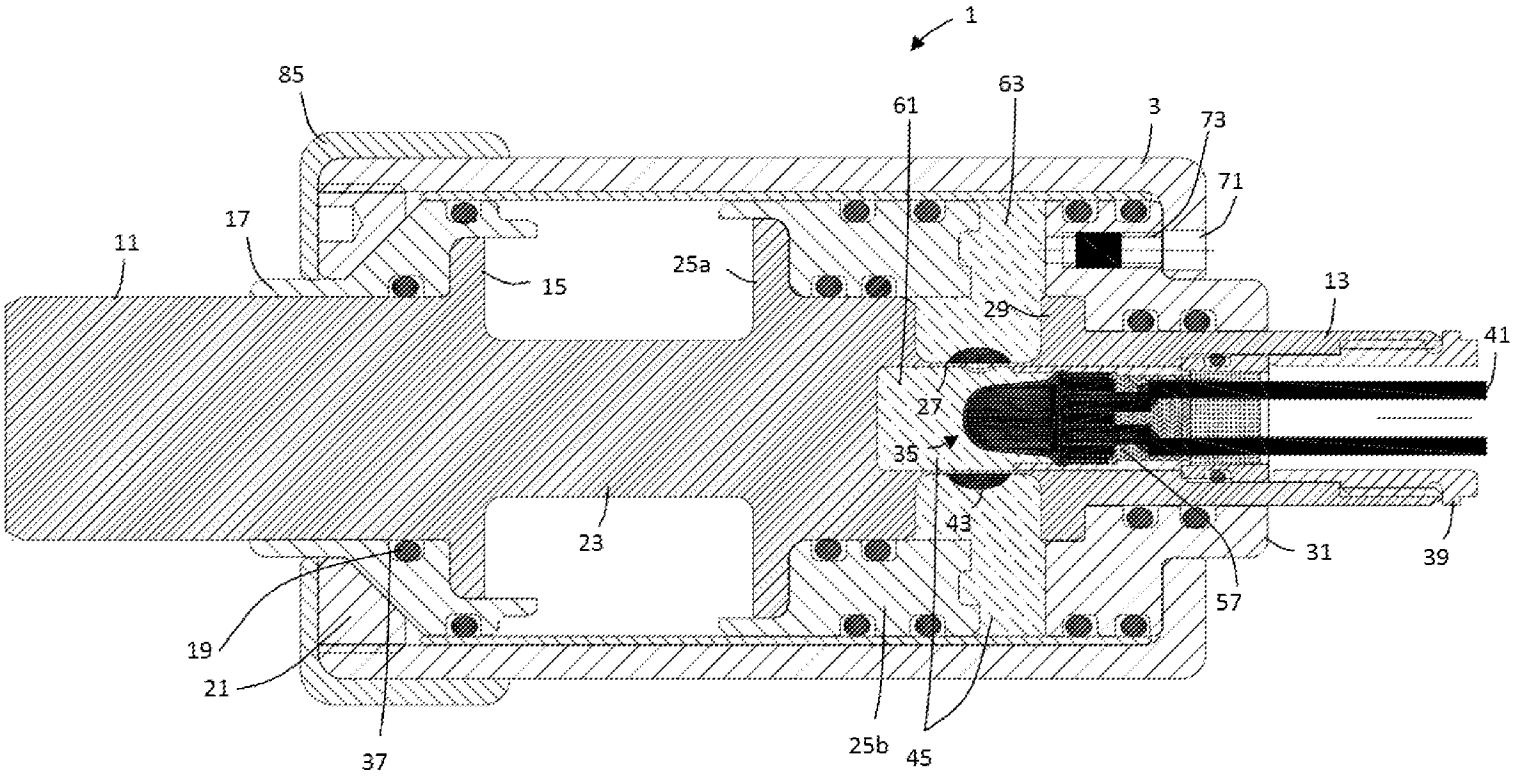
FIG. 7 shows a longitudinal section through a further embodiment of an interruption switch according to the invention in the initial state, wherein the sabot is installed as a fixed impact element; here there is no upsetting region.

The embodiment of an interruption switch 1 according to the invention represented in FIG. 7, like the previously described embodiments, comprises a casing 3 in which a contact unit 5 is arranged. The casing 3 is formed such that it withstands a pressure, generated inside the casing, which is generated in the case of a pyrotechnic tripping of the interruption switch 1, without the risk of damage or even bursting. The casing can in particular consist of a suitable metal. In this case, an insulation layer 7 which consists of a suitable insulating material, for example a plastic, can be provided on the inner wall of the casing. In the case of higher voltages, flashovers or an electrical contact between the contact unit 5, which of course consists of a conductive metal, for example of copper, and the casing 3 are hereby avoided, in particular during and after the tripping of the interruption switch 1. The casing as a whole can also consist of an insulating material, in particular of ceramic or a suitable plastic. In this case, the wall thickness of the casing 3 will usually turn out to be thicker than in the case of a metallic casing; as a rule, reinforcing ribs must then also be introduced here.

However, in the embodiment example represented, the contact unit 5 is designed solid in the region of the first connection contact 11, in the region 23 and in the region of the impact element 25, in contrast to the previously mentioned embodiments. Only in the separation region 27 is the contact unit 5 formed as a tube, as in the previously described embodiments.

The advantage of this embodiment, in which there is no upsetting of the earlier upsetting region 23, is that after the breaking open of the separation region no fluid is removed from the separation region here as a result of the movement of the sabot 25*b*, the whole switching operation is thus effected virtually stationary. Thus the shutoff operation is concluded more quickly. A further advantage is that the loop-in resistance of the assembly, i.e. the ohmic resistance between the connection contact regions 11 and 13, is minimal here, and even with high operating currents much less heat loss is generated here, which would have to be dissipated—the relatively thin material in the upsetting region 23 in the other embodiments of the assembly is actually solid metal here. The relatively small separation distance after the tripping of the assembly and the relatively small movement of the filling material during the switching operation can be mentioned as a disadvantage here.

Figure 8:
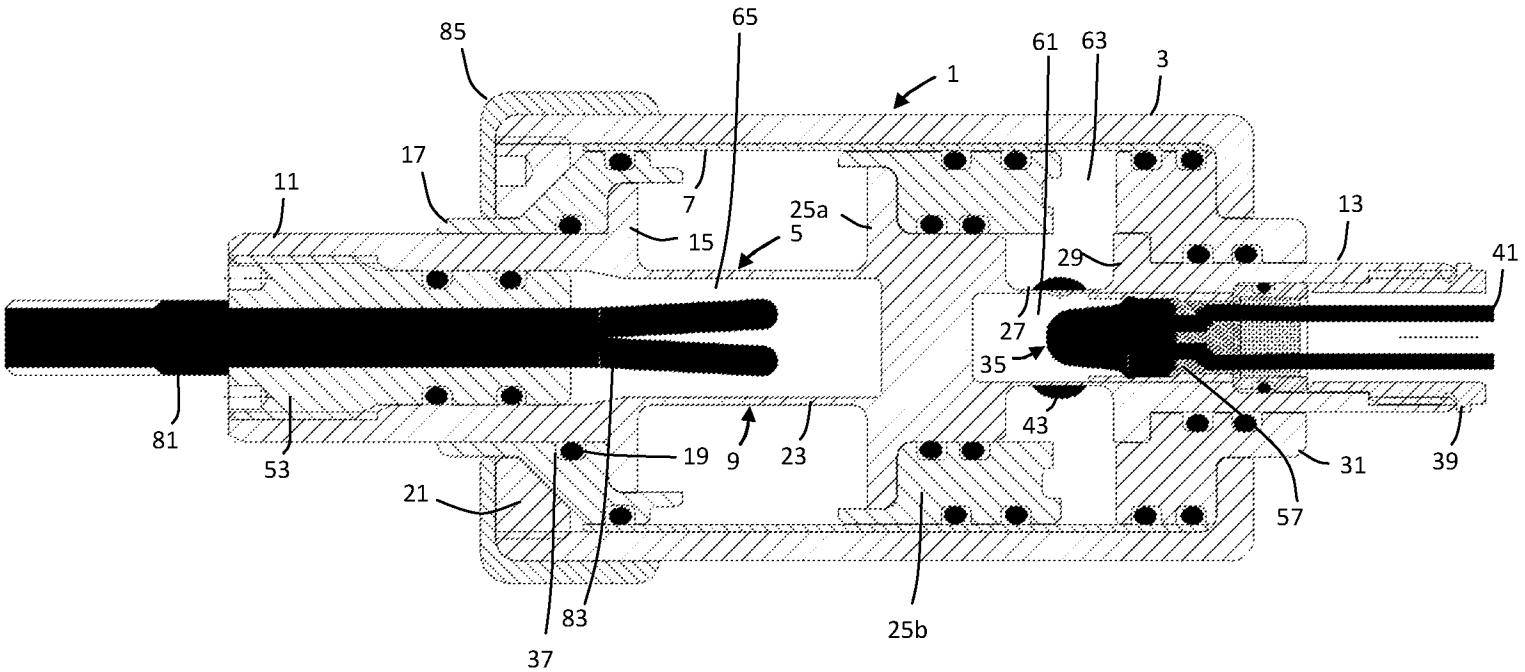
FIG. 8 shows a longitudinal section through an interruption switch according to the invention in the initial state, as in FIG. 1, wherein a third connection contact is provided and in which none of the chambers is filled with a filling agent.

The embodiment of an interruption switch 1 according to the invention represented in FIG. 8 comprises a casing 3 in which a contact unit 5, also called connecting element, is arranged. The casing 3 is formed such that it withstands a pressure, generated inside the casing, which is generated in the case of a pyrotechnic tripping of the interruption switch 1, without the risk of damage or even bursting. The casing can in particular consist of a suitable metal, preferably steel. In this case, an insulation layer 7 which consists of a suitable insulating material, for example a plastic, can be provided on the inner wall of the casing. Polyoxymethylene can be used here for example as plastic for this purpose. In the case of higher voltages, flashovers or an electrical contact between the contact unit 5, which of course consists of a conductive metal, for example of copper, and the casing 3 are hereby avoided, in particular during and after the tripping of the interruption switch 1. However, electrically non-conductive materials such as ceramic, POM, PA6 or ABS are also possible here as casing material, which, however, as a rule have to be suitably reinforced, for example by ribs. In these cases, the wall thickness of the casing 3 will also usually turn out to be thicker than in the case of a metallic casing.

In the embodiment example represented, the contact unit 5 is formed as a switch tube 9 depressed in the upsetting region by the sabot 25*b*, with the result that it is formed as a tube only in the separation 27 and the upsetting 23 region. In the embodiment example represented, the switch tube 9 has a first connection contact 11 with a larger diameter and a second connection contact 13 with a smaller diameter. Adjoining the first connection contact 11 is a flange 15 extending radially outwards, which is braced on an annular insulator element A 17, which consists of an insulating material, for example a plastic, in such a way that the switch tube 9 cannot be moved out of the casing 3 in the axial direction. The plastic used for this can be polyoxymethylene, ABS or nylon, but ceramics are also possible and in special cases are useful. For this purpose, the insulator element A 17 has an annular shoulder, on which the flange 15 of the switch tube 9 is braced. In addition, the insulator element A 17 insulates the casing from the switch tube 9. The annular insulator element A 17, in an axially outer region, has an internal diameter which substantially corresponds to the external diameter of the switch tube 9 in the region of the first connection contact 11. As a result, a sealing action is achieved, which is strengthened by an additional annular sealing element 19, for example an O-ring. The insulator element A 17 can also be connected to the switch tube 9 via a press fit, or injection-molded onto it. The insulator element A 17 and thus the switch tube 9 or the contact unit 5 is held in the casing 3 on the respective end face of the interruption switch 1 by means of a locking nut 21 or a welded-in washer 21, or fixed in the casing 3 in this way. The locking nut 21 or the washer 21 can consist of metal, preferably steel. It is hereby also ensured that the switch tube cannot escape from the casing if the plastic parts of the interruption switch 1 soften or burn, even if the interruption switch 1 is tripped again in this state. This is because the external diameter of the flange 15 is chosen to be greater than the internal diameter of the locking nut 21.

However, the casing 3 can of course also be reshaped on the end face represented on the left in FIG. 8 during the assembly of the interruption switch 1 in such a way that a part of the casing extending radially inwards fixes the insulator element 17. If the casing consists of plastic, the insulator element 17 can also be omitted.

The switch tube 9 has an upsetting region 23 adjoining the flange 15 in the axis of the switch tube 9. In the upsetting region 23 the wall thickness of the switch tube 9, which has a predetermined axial extent, is chosen and adapted to the material in such a way that, when the interruption switch 1 is tripped, as a consequence of a plastic deformation of the switch tube 9 in the upsetting region 23, the upsetting region is shortened in the axial direction by a predetermined distance.

In the axial direction of the switch tube 9, a flange 25*a*, on which a sabot 25*b* is seated in the embodiment example represented, follows the upsetting region 23. The sabot 25*b*, which in the embodiment example represented consists of an insulating material, for example a suitable plastic, engages around the switch tube 9 with its part 25*b* in such a way that an insulating region of the sabot 25*b* engages between the outer circumference of the flange 25*a* and the inner wall of the casing 3. If a pressure acts on the surface of the sabot 25*b*, a force is generated which compresses the upsetting region 23 of the switch tube 9 via the flange 25*a*. This force is chosen such that, during the tripping operation of the interruption switch 1, upsetting of the upsetting region 23 occurs, wherein the sabot 25*b* is moved out of its starting position (status prior to the tripping of the interruption switch 1) into an end position (after the completion of the switching operation).

As can be seen from FIG. 8, the sabot part 25*b* can be chosen such that its external diameter substantially corresponds to the internal diameter of the casing 3, with the result that an axial guidance of the flange 25*a* and thus also an axially guided upsetting movement is achieved during the switching operation.

After the pressing operation, the lugs of the insulator 17 and of the sabot 25*b* lying near the casing engage over each other completely, with the result that the upsetting region 23, which has been pushed together in a meandering fashion after the tripping and the upsetting operation, is completely surrounded by electrically insulating materials.

Adjoining the sabot 25*b* or the flange part 25*a* of the switch tube 9 or of the contact unit 5 is a separation region 27 which in turn is preferably adjacent to a flange 29 of the switch tube 9 in the axial direction. The second connection contact 13 of the switch tube 9 then follows the flange 29. The flange 29 in turn serves to fix the switch tube 9 or the contact unit 5 securely in the casing 3 in the axial direction. This purpose is served by an annular region of the casing 3 (not provided with a reference number) extending radially inwards and a closure 31, which is provided between a corresponding stop face of the flange 29, the inner wall of the end-face annular region 3*a* of the casing 3 and the axial inner wall of the casing 3, and which annularly engages around the second connection contact of the switch tube 9. The flange can—as shown in FIG. 8—engage in the closure 31 in the axial direction. As an alternative to this it can also be placed on the closure 31 in the axial direction (see FIGS. 3 to 6). The closure 31 can consist of metal, in particular steel.

If the closure 31 does not consist of a metal or a ceramic but rather of a plastic, a metal disc with a diameter which is greater than the right-hand opening of the casing must be introduced after the flange 29 in order, in the event of fire—in the event of fire the plastic parts are no longer there of course—to prevent parts from escaping from the casing.

If the casing 3, the closure 31 and the locking nut/washer 23 are made of steel, it is possible to join these parts to each other by electron-beam or ultrasonic welding. Joining by laser beam is also possible.

In the embodiment example represented, during the assembly of the interruption switch 1, the sabot 25*b* is pushed onto the switch tube 9 from the side of the connection contact 13 and must therefore be dimensioned such that its internal diameter is greater than or equal to the external diameter of the flange 29.

The closure 31 is designed as an annular component, which has an external diameter which substantially corresponds to the internal diameter of the casing 3, and an internal diameter which substantially corresponds to the external diameter of the flange 29 or the second connection contact 13.

An ignition device 35 with pyrotechnic material, often also called mini detonator or priming screw here, is provided in the axial end of the switch tube 9 in the region of the second connection contact 13. The external circumference of the ignition device 35 is sealed off from the inner wall of the switch tube 9 or of the second connection contact 13 by a sealing element (dark circular element in recess), for example an O-ring. To axially fix the ignition device 35, a small shoulder can be provided in the inner wall of the switch tube 9 or of the second connection contact 13, wherein during the assembly of the interruption switch 1 the ignition device is pushed into the switch tube 9 as far as the shoulder. To axially fix the ignition device 35, a locking element 39 is then screwed into the second connection contact 13. The electrical connection lines 41 of the ignition devices 35 can be passed outwards through an opening in the annular closure 31. For complete sealing and fixing, the interior of the locking element 39 can be potted, in particular with a suitable epoxy resin. This then serves simultaneously to relieve strain on the connection lines 41. In the region where the connection lines 41 enter the ignition device 35, the connection lines can be fixed using a potting compound 57. In FIG. 8, the locking element 39 is provided with a screw thread in order that it can be screwed into the second connection contact 13 of the switch tube 9 but later, if the assembly is implemented in series, for cost reasons it is merely pushed into the second connection contact 13 preferably formed as a tubular part, and then crimped in, clinched or curled.

The closure 31 can consist of a metal, in particular steel. This has the advantage of the connection of potential between the casing 3 and the second connection contact 13. In this way "the casing knows where it belongs with respect to the potential". The latter is important in high-voltage circuits in order not to obtain any undesired electric arcs with parts having no connection of potential. In addition, the casing 3 shields the inner region of the interruption switch 1 from electromagnetic radiation, e.g. a radar beam.

The separation region 27 is dimensioned such that it at least partially tears open due to the generated gas pressure or the generated shock wave of the mini detonator 35, with the result that the pressure or the shock wave can also propagate out of the one chamber (combustion chamber 61) into the further chamber 63 designed as a surrounding annular space. To facilitate the tearing open, the wall of the switch tube 9 can also have one or more openings or holes in the separation region 27. In addition, an ignition mixture 43 can also be provided in the separation region 27 on the side of the further chamber 63. The openings and the ignition mixture are preferably covered with a protective lacquer 55 (shown by way of example in FIG. 5). The ignition mixture 43 can also be covered with a layer of natural rubber for protection against the influences of the filling material. In the event that the actuation of the mini detonator 35 fails, the ignition mixture 43 can serve to bring about a passive shutoff, i.e. to separate the separation region 27, without the ignition device 35 having been actively tripped: in the case of excess current, the center part of the separation region 27 in particular heats up very strongly and very quickly and in the process ignites the ignition mixture when the ignition temperature is reached, which then again suitably ignites the ignition device 35 or the pyrotechnic material with it.

The ignition mixture 43 can likewise already be a priming charge, which already generates a shock wave on its own when heated to its ignition temperature and thus already tears open the separation region—now inwards here—and then depresses the sabot. In this case, it would therefore not be necessary at all for the ignition device 35 or the mini detonator to act or ignite as well. If it is not desired to actively trip the assembly, this priming charge would already also be sufficient to sever the switch separator and to upset the upsetting region 23 of the switch tube 9.

The ignition device 35 for igniting the pyrotechnic material (ignition device) can consist of a simple, rapidly heatable glow wire. The activation of the ignition device can be effected by a corresponding electrical actuation. However, the ignition device 35 can of course also be formed in any other desired way which brings about an activation of the pyrotechnic material, also in the form of a conventional igniter, an ignition tablet, a squib or a mini detonator.

In addition or instead, a passive activation of the interruption switch 1 can be provided. For this, the increase in temperature of the material of the switch tube 9 in the separation region 27 is utilized. In this case, there should be as direct a contact as possible between the pyrotechnic material and the inner wall and/or outer wall of the switch tube 9 in the separation region 27. In addition, a more easily activatable material, in particular an ignition mixture or priming charge, can also be provided in close proximity to or applied to the inner wall and/or outer wall of the separation region.

FIG. 8 shows such a layer of an ignition mixture 43 which is applied in paste form to the outer wall of the separation region. If a filling material is poured in, this ignition mixture must be protected from the filling material on all sides, for example by a layer of epoxy resin or natural rubber.

The electrical resistance and thus also the thermal behavior of the separation region 27 can be influenced by the provision of openings in the wall of the separation region 27 (in conjunction, of course, with the wall thickness of the separation region and the dimensioning of the radii at the transitions of the separation region, which substantially determine the heat outflow from the separation region and its rupturing behavior). As a result, the current-time integral at which the interruption switch 1 trips passively can be defined or set. The inertia can also be influenced by such a dimensioning.

In the case of an activation of the interruption switch 1 by means of the ignition device 35 or by means of a passive activation, a pressure or a shock wave is thus generated on the side of the sabot **25*b* facing away from the upsetting region 23, as a result of which the sabot is exposed to a corresponding axial force. This force is chosen by a suitable dimensioning of the pyrotechnic material such that the switch tube 9 is plastically deformed in the upsetting region 23, and consequently the sabot is moved in the direction of the first connection contact 11. The pyrotechnic material is dimensioned such that, after the breaking open of the separation region 27 of the switch tube 9, the sabot 25*b* is moved into the end position represented in FIG. 6**.

Immediately after the activation of the pyrotechnic material, the separation region 27 is therefore at least partially torn open. If the tearing open does not already take place before the start of the axial movement of the sabot **25*b* over the entire circumference of the separation region 27, a remaining portion of the separation region, which causes another electrical contact, is completely torn open by the axial movement of the sabot 25*b***.

Depending on the dimensioning of the separation region and of the pyrotechnic material, it is also conceivable that the separation region initially does not tear open after the activation but rather that the gas pressure acts only through corresponding openings in the wall of the separation region, also in the annular region surrounding the separation region 27. The tearing open of the separation region 27 can then be effected substantially only by the axial force on the sabot **25*b***, which also leads to the axial movement thereof.

The rupturing behavior can also be further controlled by corresponding choice of the pyrotechnic material and optionally of the ignition mixture comprised of it.

In particular, the gas pressure generated by the burn-off or the shock wave generated can be well controlled by introducing readily gasifiable liquids or solids into the space in which the pyrotechnic material is contained or into which the hot gases generated penetrate. Thus, in particular water, in solution with the filling material or in the form of microcapsules, gels etc., increases the gas pressure considerably. An increase in the gas pressure brought about in this way can turn out to be even more extreme if the water introduced into the combustion chamber is superheated, in particular because the strongly heated water experiences explosive decompression when the separation region 27 breaks open.

The interruption switch shown in FIG. 8 has, inside the switch tube 9 on the axial side facing the first connection contact 11, an insulator element B 53 as filling piece, through which a third connection contact 81, the so-called center electrode, which preferably has a fanned out or split end 83, can be passed from the outer space of the interruption switch into the yet further chamber 65. The insulator element B 53 also serves as closure for the yet further chamber 65. The insulator element B 53 is preferably formed as a cylindrical part. The insulator element B 53 can be made of a plastic, such as for example PEEK, polyoxymethylene, ABS or nylon. The cylindrical insulator element B 53 is pressed into the hollow-cylindrical first connection contact 11. The insulator element B 53 preferably has recesses 37 for receiving sealing elements, which bring about a sealing between the axial outer wall of the insulator element B 53 and the inner wall of the first connection contact 11. In the embodiment shown in FIG. 2, the combustion chamber 61 and the further chamber 63 are filled with the filling material 45, while the yet further chamber 65 is not filled with filling material. However, it is also conceivable according to the invention to also fill the yet further chamber 65 with the filling material 45. It is also conceivable according to the invention that none of the chambers 61, 63 and 65 is filled with a filling material. It is also conceivable that, in place of the center electrode 81, only a sealing screw (not shown) is used.

The embodiment shown in FIG. 8 is simpler than the embodiments shown in FIGS. 2 to 5. However, here only material thicknesses in the separation region of up to approx. 200 μm with 5 to 10 times the quantity of required pyrotechnic material can be broken open. The switching limit of this simple embodiment is only approx. 1000 A direct current at 800 V. In contrast, the switching limit in embodiments with filling material is approx. 30 kA direct current with ⅕ of the pyrotechnic material used.

FIG. 9 shows by way of example a circuit diagram of an electric circuit before activation, in which an interruption switch S1 according to the invention is integrated. Here, the first connection contact (thick) is connected to the load circuit, consisting of R2, L1, C2 and R5, the second connection contact (thin) is connected, for example, to the positive pole of the current source (Batt 1). The third connection contact (the so-called center electrode) is here connected to earth or to the negative pole of the current source or to the negative terminal of the consumer. If the electric circuit is now interrupted by switching the interruption switch—the switch contact shown flips from "thin" to the terminal of the "center electrode in thick"—then, shortly after the start of the upsetting operation in the assembly, the mechanical energy stored electrically in the capacitance C2 and above all the mechanical energy stored in the whole inductance of the load circuit L1 is discharged or short-circuited to earth, by-passing the separation point via the center electrode, which here acts as a short-circuit electrode. In this way, the actual separation point in the assembly is unloaded and the formation of an electric arc there is greatly weakened or attenuated, the separation point in the assembly has to dissipatively convert much less energy and the high switching voltage generated here during shutting off is lowered considerably.

Here, L2 is the inductance of the current source (Batt 1) and of the wiring to the interruption switch, R1 is the internal resistance of the current source, and C3 is the capacitance of the current source. R3 is the loss resistance of the wiring to the interruption switch. R2 is the load resistance and L1 is the inductance of the load circuit including wiring to the interruption switch. C2 is the capacitance of the whole load circuit and R5 is the loss resistance of the wiring to the interruption switch. C1 and R4 are an RC combination, i.e. a so-called spark quenching combination for switch contacts which are opening, such as is usually used for relay contacts, but it does not necessarily need to be present in the circuit when the assembly is used and, as a rule, it is even omitted for cost reasons.

In the upper partial image, FIG. 10 shows a part of a switch tube 9 in the region of the combustion chamber 61 with a concave design of the combustion chamber wall, which lies opposite the pyrotechnic material, while in the lower partial image this combustion chamber wall is formed convex. The pointed cones shown here can, however, also have another shape, for example be correspondingly rounded. In particular, when the combustion chamber 61 is filled with filling material, preferably silicone oil, and the pyrotechnic material is a mini detonator, a shock wave guidance results here which, at the optimal angle α—this is strongly dependent on the combustion chamber material, the spacing between the mini detonator and the wall, the filling material and the type of pyrotechnic material—greatly strengthens the mechanical effect of the shock wave generated and thus allows even thicker separator material to break open with a minimum of pyrotechnic material. In the lower partial image, FIG. 10 likewise shows a part of a switch tube 9, with a convex design of the combustion chamber wall.

In FIG. 11 the ignition device 35 is accommodated not in the previous chamber 61 but in the chamber 63; the electrical terminals of the ignition device are passed out of the casing at the top. The sequence is similar to that in the embodiments described in FIGS. 1 to 5 but here the separation region 27 is not torn open from inside but compressed from the outside and the sabot 25*b* is already depressed beforehand. The suppression or impeding of the electric arc at the separation point is again effected by the circulating filling material, preferably the silicone oil.

This embodiment is to be used in the case of very large assemblies in which the required pyrotechnic material can no longer be housed in chamber 63—in this case the mini detonator would also, for example, become a detonator of normal size.

In FIG. 12 the ignition device 35 is located just outside the casing: here, the pressure energy required for depressing the separation region 27 and sabot 25*b* would, for example, be introduced into the assembly with fluid connection from outside via a tube system. This embodiment would be suitable for particularly large assemblies or circuit breakers—for all of these cases, however, other pressure generators would then also have to be taken into consideration, i.e. compressed gas storage, $CO_2$ cartridges, chemical gas generators or vaporizers, but also gasifiers of all types.

All the sealing elements 19 (or O-rings) in FIGS. 1 to 8 and FIGS. 11 to 12, which can be present in the recesses 37, can be made of nitrile butadiene rubber, Viton or silicone, wherein nitrile butadiene rubber is preferred.

FIG. 13 shows an interruption switch according to the invention with two separation regions 27 on opposite sides in the state before the ignition device 35 is tripped. The interruption switch is constructed mirror-symmetrically, and thus also has two upsetting regions 23. The functioning of each mirror-symmetrical part is substantially as described with respect to FIG. 1. The chamber 61 and/or the further chamber 63 and/or the yet further chamber 65 can be filled with a filling material (not shown). FIG. 14 shows the interruption switch from FIG. 13 after the ignition device 35 has been tripped.

FIG. 15 shows an arrangement in which an interruption switch 1 according to the invention is connected in parallel with a safety fuse 87, as described further above. The current I divides as a result of the parallel connection into partial currents $I_1$ and $I_2$, wherein $I_1$ is the current of the safety fuse 87 and $I_2$ is the current of the interruption switch 1.

FIG. 16 shows by way of example an arrangement in which an interruption switch 1 according to the invention is connected in series with two safety fuses 87, to which the current I is applied. The two safety fuses 87 here are connected before and after the interruption switch 1, i.e. connected to the negative and positive terminals of the interruption switch 1. In such an arrangement the safety fuses have the task mentioned further above.

FIGS. 15 and 16 furthermore each show an interruption switch which comprises a rubber ball 89 as an example of the above-named material, which locally weakens the influence of the shock waves forming when the interruption switch is tripped. For this purpose, the rubber ball 89 is preferably mounted inside the hollow nut 33.

FIG. 17A shows a hollow-cylindrical separation region 27 with two circumferential grooves 91—as described generally further above. FIG. 17B shows an interruption switch 1 according to the invention with a separation region 27—as shown in FIG. 17A.

FIG. 18A shows a hollow-cylindrical separation region 27 with a circumferential thickening (small lump) 93—as described generally further above. Furthermore, the separation region 27 shown in FIG. 18A has a circumferential groove 91 in each case to the left and right of the circumferential thickening 93. FIG. 18B shows an interruption switch 1 according to the invention with a separation region 27—as shown in FIG. 18A.

The interruption switch 1 in FIGS. 17B and 18B also has a heat sink 1 95 and a heat sink 2 97—as are described generally further above. The heat sinks 95 and 97 are only represented by way of example in these figures and can be combined with any further embodiment of the invention. The heat sink 1 95 is preferably mounted in the further chamber on the sabot, and the heat sink 2 97 is mounted on the internal insulation of the casing 3. The heat sink 1 95 can be formed circumferentially, i.e. tubular, or lamellar. The heat sink 2 97 preferably runs circumferentially on the inside of the casing 3 or the internal insulation thereof, i.e. is formed tubular.

LIST OF REFERENCE NUMBERS

1 interruption switch, circuit breaker, assembly
3 casing
5 contact unit
7 insulation layer
9 switch tube, connecting element
11 first connection contact
13 second connection contact
15 flange
17 insulator element A
19 sealing element (O-ring)
21 locking nut/washer
23 upsetting region/region
25*a* flange
25*b* sabot
27 separation region
29 flange
31 closure
33 hollow nut/closure
35 ignition device with pyrotechnic material, mini detonator, igniter
37 recesses for sealing elements
39 locking element
41 electrical connection lines
43 ignition mixture
45 filling material
49 channel
53 insulator element B
57 potting compound
61 chamber/combustion chamber
63 further chamber
65 yet further chamber
71 casing hole
73 threaded hole
81 third connection contact
83 split end of the third connection contact
85 protective cap, omitted when the casing 3 is in one piece or is welded on both sides.
87 safety fuse
89 rubber ball
91 circumferential grooves
93 circumferential thickening (small lump)
95 heat sink 1
97 heat sink 2
I current
$I_1$ partial current
$I_2$ partial current
S1 interruption switch with first, second and third connection contact
thick first connection contact of the interruption switch
thin second connection contact of the interruption switch
Batt1 current source
R1 internal resistance of the current source
C3 capacitance of the current source
L2 inductance from current source and wiring to the interruption switch
R3 loss resistance of the wiring to the interruption switch
R2 load resistance
L1 inductance of the load circuit including wiring to the interruption switch
C2 capacitance of the whole load circuit
R5 loss resistance of the wiring to the interruption switch
C1+R4 RC combination, so-called spark quenching combination for switch contacts which are opening
center electrode third connection contact of the interruption switch, sensor unit, provided feedback about the state of the circuit breaker is only to be given, or short-circuit electrode.

The invention claimed is:

1. An electrical interruption switch for interrupting high currents at high voltages, the electrical interruption switch comprising:

a casing, which surrounds a contact unit defining a current path through the electrical interruption switch, and a pyrotechnic material, which comprises an activatable material, the activatable material being one or more of gas-generating and shock wave-generating, activatable material, wherein the contact unit has a first and second connection contact and a separation region, wherein the pyrotechnic material and the contact unit are formed such that a current to be interrupted is supplied to the contact unit via the first connection contact and is discharged therefrom via the second connection contact, or vice versa, and that, when the pyrotechnic material is ignited, the separation region is exposed to one or more of a gas pressure and shock wave generated by the activatable material, such that the separation region is torn open, caved in or separated, wherein:

at least one chamber in the electrical interruption switch, which is at least partially delimited by the separation region, is substantially completely filled with a filling material, such that the separation region is in direct contact with the filling material.

2. The electrical interruption switch, according to claim 1, wherein the separation region at least partially surrounds the at least one chamber.

3. The electrical interruption switch, according to claim 1, wherein the separation region separates the at least one chamber from a further chamber which surrounds the separation region annularly.

4. The electrical interruption switch according to claim 3, wherein, during the separation of the separation region the at least one chamber is connected to the further chamber.

5. The electrical interruption switch according to claim 3, wherein both the at least one chamber and the further chamber are substantially completely filled with the filling material.

6. The electrical interruption switch, according to claim 1, wherein the pyrotechnic material is located in the at least one chamber, which is filled with the filling material.

7. The electrical interruption switch, according to claim 1, wherein the contact unit has an upsetting region.

8. The electrical interruption switch according to claim 7, wherein the upsetting region surrounds a yet further chamber.

9. The electrical interruption switch according to claim 7, wherein the upsetting region is selected with regard to the material and the geometry such that a wall of the upsetting region is folded in a meandering fashion, as a result of the upsetting movement.

10. The electrical interruption switch according to claim 7, wherein the upsetting region is formed one or more of hollow-cylindrical and annular in cross section.

11. The electrical interruption switch according to claim 7, further comprising a sabot which, when the pyrotechnic material is ignited, is exposed to one or more of a gas pressure and shock wave generated by the activatable material in such a way that the sabot in the casing is moved in a movement direction from a starting position into an end position and in the process the upsetting region is plastically deformed, wherein the separation region is completely separated, and in the end position of the sabot an insulation spacing is achieved between separated ends of the separation region.

12. The electrical interruption switch according to claim 11, wherein the contact unit has a straight longitudinal axis, along which the sabot is displaceable, wherein the separation region and the upsetting region are arranged in each case on opposite sides of the sabot and bordering it, and are provided lying in the longitudinal axis.

13. The electrical interruption switch according to claim 11, wherein a third connection contact or a sensor is present which, when the sabot is moved in the direction of the end position, is one or more of mechanically and electrically actuated and thus serves as detection means for an effected tripping of the electrical interruption switch.

14. The electrical interruption switch according to claim 13, wherein the third connections contact is present, and wherein the third connection contact is electrically connected to the second connection contact.

15. The electrical interruption switch according to claim 14, wherein the third connection contact is present and wherein the third connection contact formed as a wire or rod is split into at least two parts at its end projecting into the electrical interruption switch, in order to be more easily deformable.

16. The electrical interruption switch, according to claim 1, wherein the separation region is formed one or more of hollow-cylindrical and annular in cross section.

17. The electrical interruption switch according to claim 1, wherein the activatable material comprises a shock wave-generating material, and wherein a wall of the separation region is configured to affect a shock wave guidance.

18. The electrical interruption switch according to claim 1, wherein the contact unit has a first connection contact region containing the first connection contact and a second connection contact region containing the second connection contact, which are arranged in each case on opposite sides of the separation region.

19. The electrical interruption switch according to claim 18, wherein the first connection contact region is arranged lying in the longitudinal axis and bordering the upsetting region, and the second connection contact region is arranged lying in the longitudinal axis and bordering the separation region.

20. The electrical interruption switch according to claim 18, wherein the first connection contact region is one or more of hollow-cylindrical and annular in cross section.

* * * * *